US008439812B2

(12) United States Patent
Dytchkowskyj et al.

(10) Patent No.: US 8,439,812 B2
(45) Date of Patent: May 14, 2013

(54) MACHINE FOR SECURING A CLOSURE SYSTEM ONTO A DISCRETE POUCH

(75) Inventors: David Z. Dytchkowskyj, Appleton, WI (US); Lawrence D. Mikulsky, De Pere, WI (US); Scott R. Grasse, Hortonville, WI (US); Daniel J. Moran, Appleton, WI (US); Peter T. Hunnicutt, Greenville, WI (US)

(73) Assignee: CMD Corporation, Appleton, WI (US)

( * ) Notice: Subject to any disclaimer, the term of this patent is extended or adjusted under 35 U.S.C. 154(b) by 0 days.

(21) Appl. No.: 13/357,098

(22) Filed: Jan. 24, 2012

(65) Prior Publication Data

US 2012/0122645 A1 May 17, 2012

Related U.S. Application Data

(62) Division of application No. 12/387,798, filed on May 7, 2009, now Pat. No. 8,128,545.

(51) Int. Cl.
*B31B 1/84* (2006.01)

(52) U.S. Cl.
USPC ..... 493/213; 493/214

(58) Field of Classification Search ..... 493/213, 493/114, 121, 115, 214, 212, 113, 246; 53/133.4, 53/139.2
See application file for complete search history.

(56) References Cited

U.S. PATENT DOCUMENTS

| | | | |
|---|---|---|---|
| 4,655,862 | A | 4/1987 | Christoff et al. |
| 4,709,398 | A | 11/1987 | Ausnit |
| 4,840,611 | A | 6/1989 | Van Erden et al. |
| 4,844,759 | A | 7/1989 | Boeckmann |
| 4,878,987 | A | 11/1989 | Ven Erden |
| 4,909,017 | A | 3/1990 | McMahon et al. |
| 5,085,031 | A | 2/1992 | McDonald |
| 5,557,907 | A | 9/1996 | Malin et al. |
| 5,564,259 | A | 10/1996 | Stolmeier |
| 5,592,802 | A | 1/1997 | Malin et al. |
| 5,638,586 | A | 6/1997 | Malin et al. |
| 5,816,018 | A | 10/1998 | Bois |
| 6,000,197 | A | 12/1999 | Ausnit |
| 6,017,412 | A | 1/2000 | Van Erden et al. |
| 6,030,122 | A | 2/2000 | Ramsey et al. |
| 6,040,033 | A | 3/2000 | Johnson |
| 6,044,621 | A | 4/2000 | Malin et al. |
| 6,065,872 | A | 5/2000 | Johnson |

(Continued)

FOREIGN PATENT DOCUMENTS

| | | |
|---|---|---|
| EP | 1795335 | 6/2007 |

*Primary Examiner* — Sameh H. Tawfik
(74) *Attorney, Agent, or Firm* — Thomas J. Connelly; Wilhelm Law, S.C.

(57) ABSTRACT

A machine is disclosed for securing a closure system onto a discrete pouch. The machine includes first, second and third stations. The first station is capable of advancing discrete pouches and lifting and folding a portion of a first major surface of each pouch upon itself to form a lip, and exposing an inner surface of a second major surface. The second station is capable of positioning and attaching a closure system transversely across the exposed inner surface. The closure system includes a track having first and second legs each having an outer surface. The first and second legs are joined together by an opening/closing mechanism which includes a movable member capable of being moved back and forth. The third station is located downstream from the second station and is capable of unfolding the lip and securing opposite ends of the lip to the outer surface of the second leg.

19 Claims, 9 Drawing Sheets

U.S. PATENT DOCUMENTS 6,088,998 A 7/2000 Malin et al.
6,110,586 A 8/2000 Johnson
6,115,892 A 9/2000 Malin et al.
6,116,314 A 9/2000 Johnson
6,131,369 A 10/2000 Ausnit
6,131,370 A 10/2000 Ausnit
6,138,329 A 10/2000 Johnson
6,151,868 A 11/2000 Matthews
6,152,601 A 11/2000 Johnson
6,167,597 B1 1/2001 Malin
6,174,397 B1 1/2001 Johnson
6,212,857 B1 4/2001 Van Erden
6,251,209 B1 6/2001 Johnson
6,273,609 B1 8/2001 Johnson
6,286,191 B2 9/2001 Van Erden
6,308,498 B1 10/2001 Malin et al.
6,321,423 B1 11/2001 Johnson
6,325,543 B1 12/2001 Ausnit
6,350,058 B1 2/2002 Linton
6,350,340 B1 2/2002 Johnson
6,383,600 B1 5/2002 Johnson et al.
6,389,651 B2 5/2002 Johnson
6,393,804 B1 5/2002 Ausnit
6,397,561 B1 6/2002 Matthews
6,428,642 B1 8/2002 Matthews et al.
6,481,183 B1 11/2002 Schmidt
6,509,080 B1 1/2003 Johnson
6,530,870 B2 * 3/2003 Buchman et al. ..... 493/394
6,553,740 B2 4/2003 Delisle
6,564,843 B2 5/2003 Johnson et al.
6,616,795 B1 9/2003 Leighton
6,620,087 B1 9/2003 Plourde
6,656,297 B2 12/2003 Schneider et al.
6,659,643 B2 12/2003 Plourde et al.
6,662,843 B1 12/2003 Johnson
6,694,704 B1 2/2004 Ausnit
6,732,898 B2 5/2004 Cortigiano et al.
6,745,545 B2 6/2004 Schneider et al.
6,751,932 B1 6/2004 Matthews
6,767,423 B1 7/2004 Johnson et al.
6,783,625 B2 8/2004 Plourde
6,804,935 B2 10/2004 Schneider et al.
6,805,485 B2 10/2004 Hogan et al.
6,807,794 B2 10/2004 Ausnit et al.
6,810,642 B2 11/2004 Cortigiano, Sr.
6,820,394 B2 11/2004 Plourde
6,820,395 B2 11/2004 Ausnit
6,821,238 B2 11/2004 Crevier et al.
6,895,725 B2 5/2005 Cortigiano, Sr.
6,902,091 B2 6/2005 Cortigiano, Sr.
6,910,995 B2 6/2005 Schneider et al.
6,928,791 B2 8/2005 Ausnit
6,929,594 B2 8/2005 Delisle
6,931,819 B2 8/2005 Schneider et al.
6,931,820 B2 8/2005 Delisle
6,942,609 B2 9/2005 Knight
6,960,021 B2 11/2005 Schneider et al.
6,983,574 B2 1/2006 Ausnit
6,986,236 B2 1/2006 Schneider et al.
6,986,237 B2 1/2006 Ausnit et al.
6,991,372 B2 1/2006 Cornelisse
7,144,159 B2 12/2006 Piotrowski et al.
7,182,513 B1 2/2007 Malin et al.
7,211,036 B2 5/2007 Ausnit
7,229,511 B2 6/2007 Cortigiano, Sr.
7,249,400 B2 7/2007 Offa-Jones
7,263,813 B2 9/2007 Schneider et al.
7,266,934 B2 9/2007 Leighton
7,318,257 B2 1/2008 Offa-Jones
7,322,920 B2 1/2008 Johnson
7,325,378 B2 2/2008 Ausnit
7,329,217 B2 2/2008 Leighton
7,374,075 B2 5/2008 Cortigiano, Sr.
7,506,487 B2 3/2009 Eads et al.
8,128,545 B2 3/2012 Dytchkowskyj et al.
8,128,546 B2 3/2012 Dytchkowskyj et al.
2010/0014790 A1 1/2010 Colla

* cited by examiner

MACHINE FOR SECURING A CLOSURE SYSTEM ONTO A DISCRETE POUCH

CROSS-REFERENCE TO RELATED APPLICATIONS

This application is a Divisional of application Ser. No. 12/387,798, filed May 7, 2009 which is incorporated herein by reference in its entireties.

FIELD OF THE INVENTION

This invention relates to a machine for securing a closure system onto a discrete pouch. The closure system is secured in a transverse direction which is perpendicular to the machine direction in which the discrete pouch is advancing.

BACKGROUND OF THE INVENTION

Today, it is commonplace to find a variety of flexible pouches which include a closure system, such as a zipper, that can be opened and closed multiple times by the ultimate consumer. These reclosable pouches are used to enclose and/or hold a wide variety of items, articles or products in solid, semi-solid or liquid form. One or more items, articles or products can be manufactured or assembled and then be packaged in these pouches. The pouches and the enclosed items, articles or products can then be shipped to wholesalers, distributors and retailers for sale to the general public. The ultimate consumers can purchase the items, articles or products packaged in these pouches at grocery stores, mass merchandise stores, home improvement stores, garden supply stores, feed stores, etc. Examples of some items, articles and products that can be enclosed in such pouches include but are not limited to: food items in solid form such as fruit, vegetables, meats, candy, cookies, snacks, etc. and food items in liquid form such as non-carbonated juices, milk, sauces, etc; personal items such as medicine, cough drops, tobacco, cosmetics, toys, office supplies, etc; household items such as plastic knives, forks and spoons, cups, rubber bands, tacks, screws, hooks, laundry detergent, soap, etc; lawn and garden items such as grass seed, fertilizer, flower seeds, pet food, animal bedding material such as wood chips, etc., and various other items such as medical instruments, dental instruments, hardware, computer parts, sporting goods, etc.

The closure system used on such pouches can vary in design. A common closure system is in the form of a zipper having a track with an opening/closing mechanism and a slide member movably attached to the opening/closing mechanism. The slide member is designed to be manually moved back and forth along the track such that the pouch can be opened or closed multiple times. This ability to open and close the pouch multiple times, permits the ultimate consumer to remove only a portion of the items, articles or products enclosed therein at any one time. Alternatively, a consumer can insert or refill the pouch if desired. The pouch can be closed or resealed to keep the remaining items, articles or products together. If the pouch is constructed from an air tight material or a fluid or liquid tight material, it may also be able to keep the items, articles or products enclosed therein fresh. This is especially important for many food items which are not all consumed at one time.

Up until now, such reclosable pouches have been constructed using two basic methods. In the first method, which involves a two step process, a pouch without a closure system is manufactured in a first machine. The pouch includes a first major surface, an oppositely aligned second major surface, a pair of sides joining the first and second major surfaces together, a closed end and an open end. The pouch is then removed from the first machine and transported to a second machine. At the second machine, the pouch is reoriented such that its open end is aligned parallel to the machine direction. A closure system is then secured to the open end in the machine direction. This method tends to be cumbersome and limits the pouches from being manufactured at high speeds.

The second method for manufacturing reclosable pouches involves an in-line process using a single machine. The closure system is first secured to a continuous flat strip of material. After the closure system is in place, the material is folded upon itself to form a tubular member. The tubular member is then intermittently sealed and transversely slit adjacent to the closure system to form discrete pouches. Although the second method is somewhat more efficient than the first method, it suffers from a major design flaw. That design flaw is that the closure system does not extend outward from the top end of the finished pouch. This makes it difficult for the ultimate consumer to locate and maneuver the slide member along the track when he or she desires to open and/or close the pouch.

Now a machine has been invented for securing a closure system onto a discrete pouch. The machine is capable of producing discrete pouches before the closure system is applied. The machine secures a closure system to each discrete pouch in a cross direction, perpendicular to the machine direction. The closure system is applied while each pouch advances in the machine direction. This allows a higher quality pouch to be manufactured as well as permitting the closure system to extend outward from the top end of the pouch.

SUMMARY OF THE INVENTION

Briefly, this invention relates to a machine for securing a closure system onto a discrete pouch. Each discrete pouch has a first major surface, an oppositely aligned second major surface, a pair of sides joining the first and second major surfaces together, a closed bottom and an open top. The machine for forming these discrete pouches includes a first station capable of receiving and advancing each discrete pouch in a machine direction. The first station is also capable of lifting and folding a portion of the first major surface upon itself to form a lip having a first surface which is exposed. The second major surface has an inner surface and a transverse edge located adjacent to the open end. The transverse edge is spaced apart from the lip such that a portion of the inner surface is exposed. The machine also has a second station located downstream from the first station. The second station is capable of positioning and attaching a closure system transversely across the exposed inner surface. The closure system includes a track having a first leg and a second leg, each having an outer surface. The first and second legs are joined together by an opening/closing mechanism. The closure system further includes a member capable of being manually moved back and forth along the opening/closing mechanism such that the opening/closing mechanism can be opened and closed. The second station secures the outer surface of the first leg to the exposed inner surface. The machine further includes a third station located downstream from the second station. The third station is capable of unfolding the lip and securing opposite ends of the lip to the outer surface of the second leg.

The general object of this invention is to provide a machine for securing a closure system onto a discrete pouch. A more specific object of this invention is to provide a machine that can secure a closure system transversely across an open end of a discrete pouch while the discrete pouch is advancing in a machine direction, which direction is perpendicular to the securement direction of said closure system.

Another object of this invention is to provide a machine that can transform a continuous web of material into a plurality of discrete pouches and then secure a closure system transversely across one end of each discrete pouch.

A further object of this invention is to provide a machine that can produce at least 20 discrete pouches per minute with each discrete pouch having a closure system transversely secured across an open end thereof.

Still another object of this invention is to provide a machine that can continuously form a plurality of discrete pouches in a machine direction and which can secure a closure system transversely across an open end of each discrete pouch.

Still further, an object of this invention is to provide a machine that can economically produce discrete pouches having a closure system transversely secured across an open end thereof and wherein the closure system can be opened and closed multiple times.

Other objects and advantages of the present invention will become more apparent to those skilled in the art in view of the following description and the accompanying drawings.

DETAILED DESCRIPTION OF THE INVENTION

Figure 1:
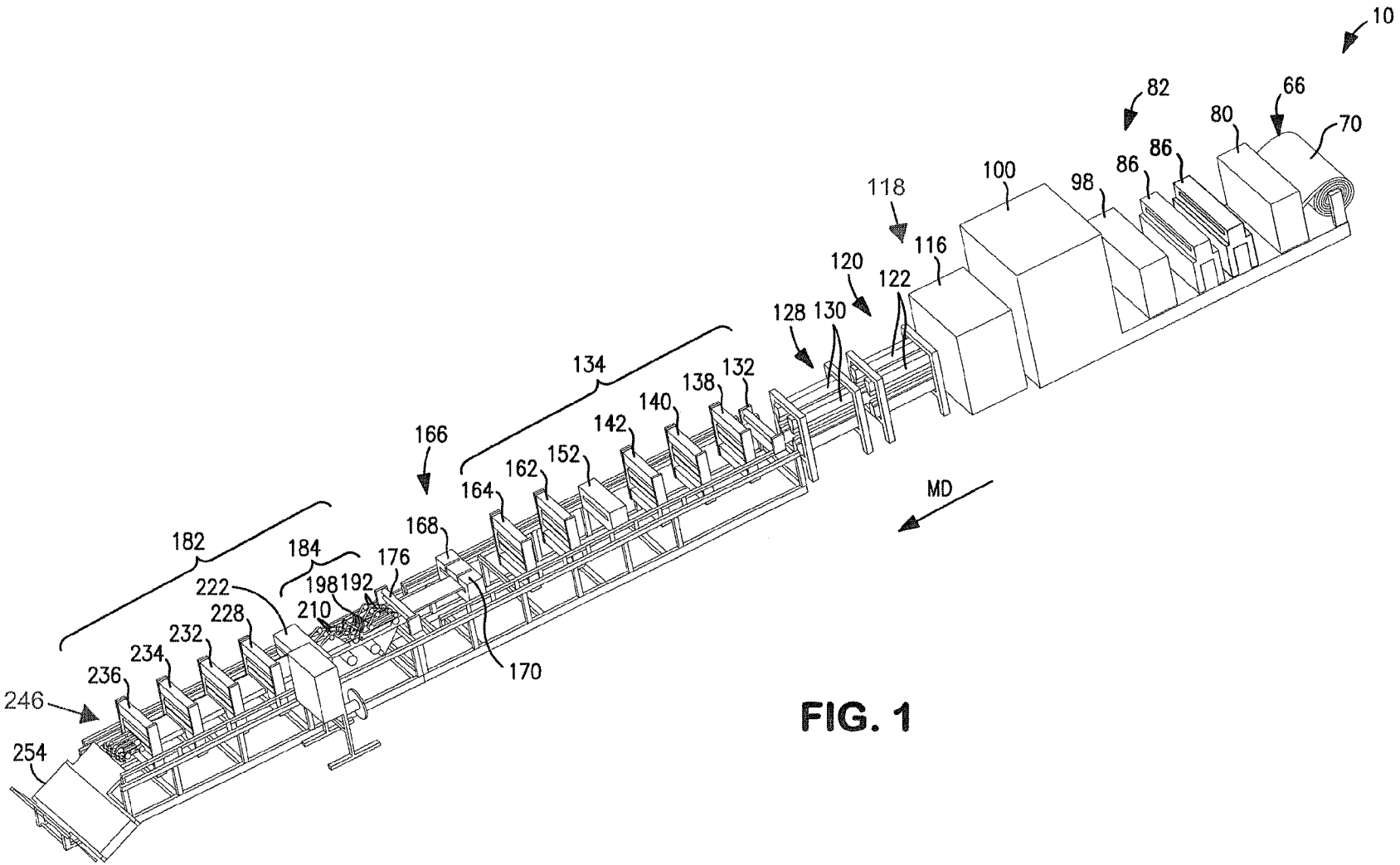
FIG. 1 is a perspective view of a machine capable of producing discrete, reclosable pouches.
Figure 2:
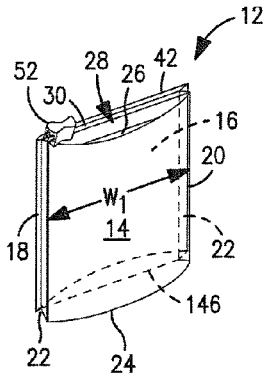
FIG. 2 is a perspective view of a discrete pouch having a closure system that can be manually moved back and forth to open and close the discrete pouch multiple times.

Referring to FIGS. 1 and 2, a machine 10 and a discrete pouch 12, respectively, are shown. The machine 10 is capable of manufacturing a plurality of the discrete pouches 12 in a cost effective and efficient manner. By "discrete" pouch it is meant a distinct thing. The discrete pouches 12 can be formed or constructed from one or more different materials. The kinds of material used to construct the discrete pouch 12 can vary. The discrete pouch 12 can be constructed from a variety of different material including but not limited to: a plastic material, a thermoplastic material, a cloth material, a film material, a polyolefin such as polyethylene or polypropylene, a low density polyethylene, a high density polyethylene, a low density polypropylene, a high density polypropylene, a polyester, a nylon material, a rayon material, a woven fabric, a non-woven fabric, cotton, paper, paper laminate, hemp, canvas, a woven polypropylene, a woven polyethylene, a mono-layered film, a multilayer film, a corn starched material, a compostable material, etc. The discrete pouches 12 can also be formed from a combination of two or more similar or different materials. The discrete pouches 12 can further be formed or constructed from any of the new green materials now being manufactured that are environmentally friendly. Desirably, the discrete pouches 12 are formed or constructed from a thermoplastic material. More desirably, the discrete pouches 12 are formed or constructed from polyethylene, polypropylene or a combination thereof.

Furthermore, the discrete pouches 12 can be formed from a laminate consisting of two or more layers. The various layers of the laminate can be identical, similar or be different in composition from an adjacent layer. At least one of the layers of the laminate can be constructed so as to prevent air from passing therethrough. Alternatively, at least one of the layers of the laminate can be constructed so as to prevent a fluid or a liquid from passing therethrough.

The discrete pouches 12 can be formed or constructed from a continuous sheet of material or from two or more individual pieces of material. Desirably, the discrete pouches 12 are formed or constructed from a continuous single web of material. The thickness of the web used to form or construct each of the discrete pouches 12 can vary. The thickness of the web used to form or construct the discrete pouches 12 can range from between about 0.001 inches to about 0.012 inches (about 1 mil to about 12 mils). Desirably, the thickness of the web used to form or construct the discrete pouches 12 can range from between about 0.001-inches to about 0.006 inches (about 1 mil to about 6 mils). More desirably, the web can have a thickness of less than about 0.0025 inches (about 2.5 mils).

Referring to FIG. 2, each of the discrete pouches 12 has a first major surface 14 and an oppositely aligned second major surface 16. For example, the first major surface 14 can represent the front of the discrete pouch 12 and the second major surface can represent the back of the discrete pouch 12. The discrete pouch 12 also has a pair of sides 18 and 20 which join the first and second major surfaces, 14 and 16 respectively, together. The pair of sides 18 and 20 can vary in size and configuration. One or both of the pair of sides 18 and 20 can be configured as a single fold, as a strip of material having a predetermined width, be shaped as a gusset or have some other desired shape. In FIG. 2, each of the sides 18 and 20 contain a gusset 22. By "gusset" it is meant a triangular insert or profile, as in the seam of a garment, for added strength or expansion. The discrete pouch 12 further has a closed bottom 24 and an open top 26. The open top 26 should extend across at least 50% of a face width $w_1$ of the finished discrete pouch 12. Desirably, the open top 26 will extend across at least 75% of the face width $w_1$ of the finished discrete pouch 12. More desirably, the open top 26 will extend across at least 90% of the face width $w_1$ of the finished discrete pouch 12. Even more desirably, the open top 26 will extend across at least 95% of the face width $w_1$ of the finished discrete pouch 12.

A closure system 28 can be secured at or adjacent to the open top 26 so that the discrete pouch 12 can be sequentially opened or closed. Those skilled in the art sometimes refer to the discrete pouches 12 as "reclosable pouches". The closure system 28 can be constructed in various shapes and designs. Desirably, the closure system 28 is a zipper. Those skilled in packaging will be familiar with various zipper designs.

Referring now to FIGS. 3-6, the closure system 28 will be described and is depicted as a zipper. However, various other closure systems are known to those skilled in the packaging art and can be used as well. Examples of a closure system that includes a zipper are taught in U.S. Pat. Nos. 4,909,017; 5,638,586; 6,805,485; 6,931,820; 6,986,237; 6,991,372 and 7,211,036; and 7,249,400.

It should be understood that the closure system 28 can vary in construction, profile and configuration. In addition, the closure system 28 does not have to include a zipper although many reclosable pouches do utilize a zipper.

The closure system 28 can be constructed from a single material or from two or more similar or different materials. Desirably, the closure system 28 is constructed from a single material. The closure system 28 can include various components. For purposes of discussion only, the closure system 28 includes at least three components. The closure system 28 includes a track 30 having a first leg 32 and a second leg 34. The first leg 32 has an inner surface 36 and an outer surface 38. The outer surface 38 can contain a heat activated substance which enables the outer surface 38 to bond to another material. For example, the heat activated substance can be an additive, a sealant which assist in forming a thermal bond, a fiber having a low melt temperature, a film having a low melt temperature, an adhesive, etc.

The second leg 34 also has an inner surface 40 and an outer surface 42. Like the outer surface 38 of the first leg 32, the outer surface 42 of the second leg 34 can contain a heat activated substance as described above which enables the outer surface 42 to bond to another material.

Figure 4:
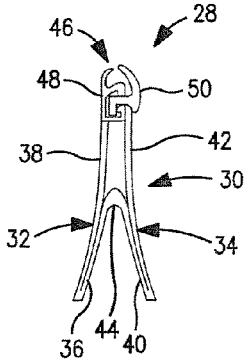
FIG. 4 is an end view of the closure system shown in FIG. 3, taken along line 3-3 but without the slide member, and showing the opening/closing mechanism in a closed position and with the first and second legs being joined together by a thin membrane.
Figure 5:
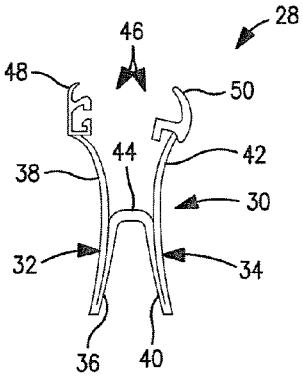
FIG. 5 is an end view of the closure system shown in FIG. 3 when the opening/closing mechanism is in an open position and with the first and second legs being joined together by a thin membrane.

Referring to FIGS. 4 and 5, the first and second legs, 32 and 34 respectively, can be folded upon themselves or they can be joined together by other means known to those skilled in the art. Optionally, a thin membrane 44 can join the first leg 32 to the second leg 34. The thin membrane 44 can be integral with the first and second legs, 32 and 34 respectively. When the thin membrane 44 is present, it is usually situated away from either end of the first and second legs, 32 and 34 respectively. The thin membrane 44 functions as a breakable seal that must be broken, ruptured or severed before the contents of the discrete pouch 12 can be removed. The thin membrane 44 can be scored such that it has a cut which extends partially through its thickness such that it can be easily broken or separated. Alternatively, the thin membrane 44 can have an area or line of weakness or reduced thickness, be notched to facilitate breakability, or be treated in some fashion to make it susceptible to be easily broken. With the design depicted in FIGS. 4 and 5, as one pulls apart the upper portions of the first and second legs, 32 and 34 respectively, the thin membrane 44 is easily broken.

The thin membrane 44 can be formed from the same material used to construct the closure system 28. Alternatively, the thin membrane 44 can be constructed of one or more materials such that an air tight or a liquid tight seal is created. The thin membrane 44 will serve as a physical barrier to prevent contaminants from contacting the items, articles or products contained within the discrete pouch 12 until the thin membrane 44 is broken. The thin membrane 44 can also serve as a tamper resistance seal to alert the ultimate consumer that no one has removed any items, articles or products from the discrete pouch 12 if the thin membrane 44 is not broken.

It should be understood that the thin membrane 44 is an optional feature and does not have to be present if it is not needed.

Referring again to FIGS. 3-5, the closure system 28 also includes an opening/closing mechanism 46 having a first part 48 and a second part 50. In FIG. 4, the opening/closing mechanism 46 is closed, and in FIG. 5, the opening/closing mechanism 46 is opened. The first part 48 is connected to the upper end of the first leg 32 and the second part 50 is connected to the upper end of the second leg 34. The opening/closing mechanism 46 is constructed such that the first part 48 is sized and configured to engage with and temporarily lock to the second part 50. The two parts 48 and 50 can be formed from the same material or from a different material. As best shown in FIGS. 4 and 5, the first part 48 has a generally C-shaped cross-section with a finger which extends upward and inward from the C-shaped cross-section. The second part 50 is generally hook shaped with a finger extending upward and inward from the hook shaped cross-section. The hook shaped cross-section of the second part 50 is sized and configured to engage with and temporarily lock to the first part 48 when the two parts 48 and 50 are pressed together. When so engaged, see FIG. 4, the pair of upward and inwardly extending fingers will approach and/or abut one another. When the first and second parts, 48 and 50 respectively, of the opening/ closing mechanism 46 are separated from one another and moved away from one another, the opening/closing mechanism 46 will be in an open position, see FIG. 5.

It should be understood that opening the opening/closing mechanism 46 will not necessarily break the thin membrane 44. In order to break the thin membrane 44, when it is present, one must forcibly pull the first part 48 away from the second part 50 such that the first and second legs, 32 and 34 respectively, will move apart and cause the thin membrane 44 to break. It should also be noted that once the thin membrane 44 is broken, it will remain broken and cannot be resealed.

It should also be understood that the opening/closing mechanism 46, depicted in FIGS. 4 and 5, is but one embodiment. Those skilled in the packaging art will know of other ways to modified or alter the design of the opening/closing mechanism 46 while still providing for a similar function.

Figure 3:
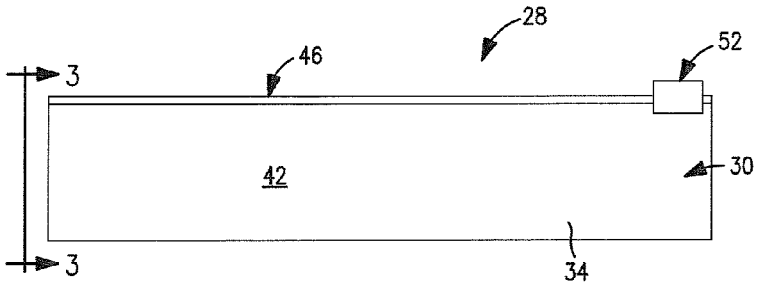
FIG. 3 is a side view of a closure system which includes a track having first and second legs, the first and second legs being joined together by a thin membrane, an opening/closing mechanism joined to the first and second legs, and a slide member capable of being manually moved back and forth along the opening/closing mechanism.
Figure 6:
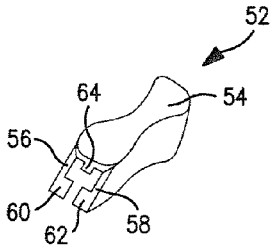
FIG. 6 is a perspective view of the slide member shown in FIG. 3 which can be manually moved back and forth along the opening/closing mechanism so as to sequentially open and close the closure system.

Referring now to FIGS. 3 and 6, the closure system 28 further includes a member 52. The member 52 can be a slidable member that is sized and configured to allow a person to pinch or grasp the member 52 between the tips of his or her thumb and forefinger on either hand. As best depicted in FIG. 6, the member 52 has a top wall 54 and first and second sidewalls, 56 and 58 respectively, which extend downwardly from the top wall 54. The top wall 54 can have a relatively smooth upper surface or be scored. The top wall 54 can be flat or contoured. The first and second sidewalls, 56 and 58 respectively, are aligned opposite to one another and each can be flat or contoured. Desirably, each side wall 56 and 58 has a concave profile. The concave profile is sized to easily receive the tips of a person thumb and forefinger and allows the member 52 to be moved back and forth without escaping from the person's grip. Each of the first and second sidewalls, 56 and 58 respectively, has an inwardly directed flange, 60 and 62 respectively. The two inwardly directed flanges 60 and 62 face one another but do not touch. The two inwardly directed flanges 60 and 62 are sized and configured such that one will contact the outer surface 38 of the first leg 32 while the other flange contacts the outer surface 42 of the second leg 34. The member 52 also has a tongue 64, see FIG. 6, formed at one end thereof which extends downwardly from the inner surface of the top wall 54. The tongue 64 is located between the first and second sidewalls, 56 and 58 respectively, but is spaced from the inner surfaces of the first and second sidewalls, 56 and 58 respectively. The tongue 64 is also distally spaced away from the flanges 60 and 62.

The member 52 is constructed and designed to interact with the opening/closing mechanism 46 so as to cause the opening/closing mechanism 46 to open when the member 52 is slid or moved in a first direction and to subsequently cause the opening/closing mechanism 46 to close when the member 52 is slid or moved in a second opposite direction. The member 52 is capable of being manually moved back and forth along the opening/closing mechanism 46 such that the opening/closing mechanism 46 can be opened and closed. This is accomplished by having the tongue 64 engage with opening/closing mechanism 46 such that it can cause the two parts 48 and 50 to separate from one another. As the member 52 is moved in an opposite second direction, the first and second flanges, 60 and 62 will urge or force the two parts 48 and 50 of the opening/closing mechanism 46 to contact one another and engage. This allows the two parts 48 and 50 to seal close the discrete pouch 12.

The member 52 can be formed or constructed from the same material as was used to construct the remainder of the closure system 28 or it can be formed or constructed from a different material. Desirably, the member 52 is constructed from a different material. More desirably, the member 52 is formed from a hard plastic. The material from which the member 52 is formed or constructed can include a color additive so that the member 52 is more visible to the ultimate consumer who will use the discrete pouch 12.

Referring again to FIG. 2, when the discrete pouch 12 is filled with items, articles or products and is offered for sale by a retailer, it will usually have the opening/closing mechanism 46 in a closed position. In this position, the member 52 will be situated at one end of the track 30. As the member 52 is moved or slid in a first direction away from the side 18 and towards the opposite side 20, the opening/closing mechanism 46 will be forced open by the tongue 64. With the first and second parts, 48 and 50 respectively, of the opening/closing mechanism 46 spaced apart from one another, the ultimate consumer can pull the first major surface 14 away from the second major surface 16 and this will cause the thin membrane 44, when present, to sever or break. The ultimate consumer will now have access to the items, articles or products contained in the discrete pouch 12. As the member 52 is moved or slid in an opposite second direction, back toward the side 18, the member 52 will urge or force the first and second parts, 48 and 50 respectively, of the opening/closing mechanism 46 to again engage, via the flanges 60 and 62, and close the closure system 28. The closure system 28 can be moved back and forth multiple times such that the discrete pouch 12 can be opened and closed multiple times. Once the discrete pouch 12 is empty of its items, articles or products, it can be discarded. Alternatively, the discrete pouch 12 can be refilled with some other items and continue to serve as a useful discrete pouch 12.

Figure 7:
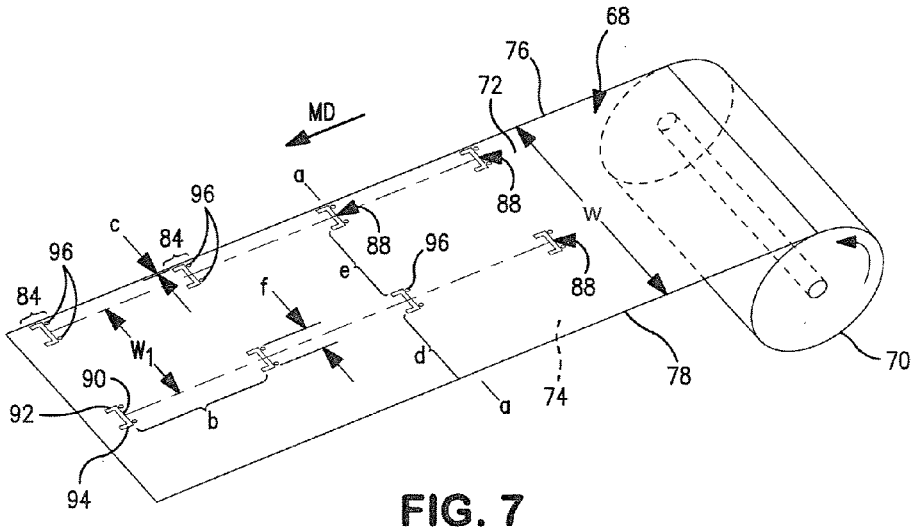
FIG. 7 is a perspective view of a web of material being unwound from a supply roll and having a predetermined pattern punched therein.
Figure 8:
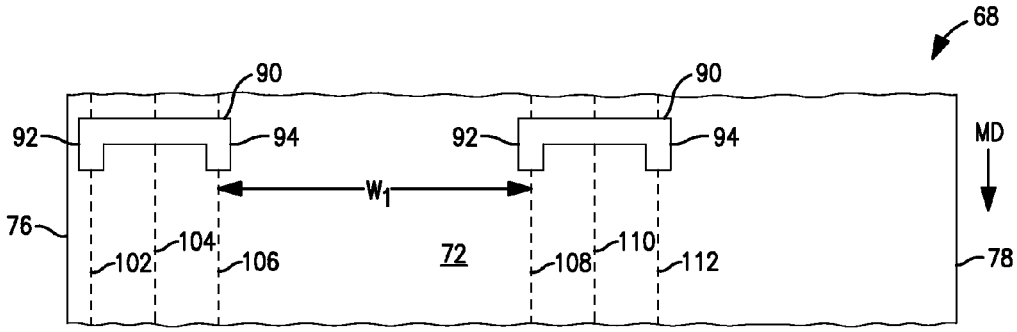
FIG. 8 is a top view of the punched web of material depicting six fold lines where it will be folded to partially form a pair of gussets.
Figure 9:
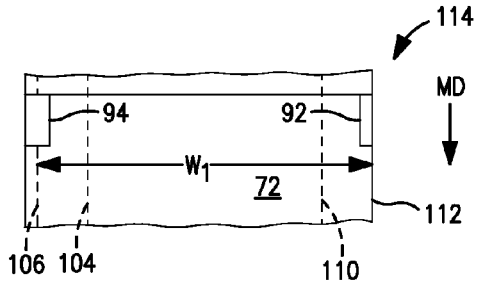
FIG. 9 is a top view of the punched web of material shown in FIG. 7 after it has been folded in half upon itself and folded to form gussets at both sides.
Figure 10:
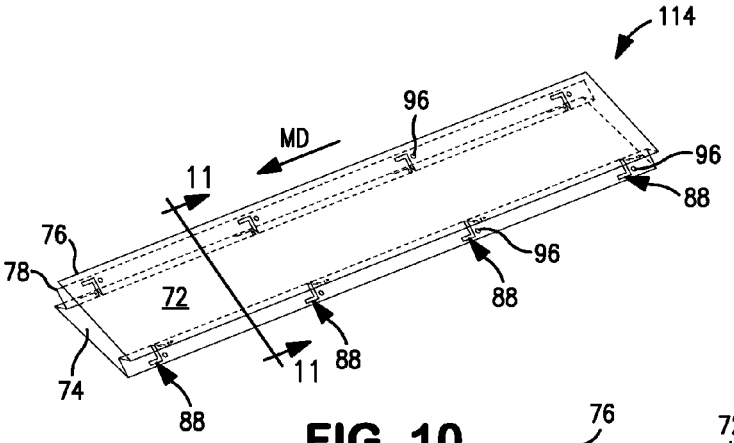
FIG. 10 is a perspective view of the continuous folded structure shown in FIG. 9.
Figure 11:
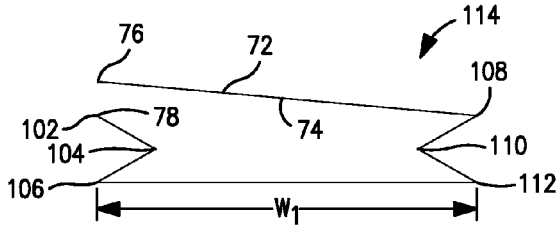
FIG. 11 is a cross-sectional view taken along line 11-11 of FIG. 10 showing the folds and gussets.

Referring now to FIGS. 1 and 7, the machine 10 is capable of forming or constructing the discrete pouch 12 in a single in-line process and securing the closure system 28 in a transverse direction as the discrete pouch 12 advances in the machine direction (MD). The transverse direction at which the closure system 28 is secured is aligned perpendicular to the machine direction (MD). The machine 10 has an unwind station 66 which is capable of unwinding a web of material 68 from a supply roll 70. The supply roll 70 is a cylindrical roll of a particular material 68 from which the discrete pouches 12 will be manufactured. The supply roll 70 can vary in diameter and width. Desirably, the supply roll 70 has a diameter of less than about 4 feet and a width of less than about 6 feet. More desirably, the supply roll 70 has a diameter of less than about 3 feet and a width of less than about 3 feet. The supply roll 70 can be a roll of thermoplastic or polyolefin material. However, as mentioned above, the material 68 wound on the supply roll 70 can be also any kind of material known to those in the packaging art that is currently used to construct flexible pouches.

The web of material 68 can be unwound from the supply roll 70 in either the clockwise or counterclockwise direction. In FIG. 1, the web of material 68 is unwound in the counter clockwise direction and the forward end of the web of material 68 is advanced through the machine 10 in a machine direction (MD). The machine direction (MD) extends from right to left in FIG. 1.

Referring again to FIG. 7, as the web of material 68 is unwound from the supply roll 70 it will become a planar web. The web of material 68 is relatively flat and has a first surface 72 and an oppositely aligned second surface 74. For example, the first surface 72 can be the upper surface and the second surface 74 can be the lower surface. The first surface 72 can be folded so as to be either the interior or exterior surface of the finished discrete pouch 12. The machine 10 and the process of forming the discrete pouches 12 will be explained with the first or upper surface 72 being folded down and under itself such that the first surface 72 will become the exterior surface of the finished discrete pouches 12. As this occurs, the second or lower surface 74 will become the interior surface of the finished discrete pouches 12. The surface of the web of material 68 that forms the exterior surface of the discrete pouches 12 can be printed to display words, numbers, symbols, graphics, photos, etc. The first surface 72 can also be partially or fully colored. One or more colors can be present on the first surface 72 and each of the colors can vary to suit one's particular printed image. Additionally, the first or exterior surface 72 can be treated, contain an additive, a sealant or some other substance to give it a glossy aesthetic appearance. To the contrary, the second surface 74 of the web of material 68 is usually void of any printing, coloring or coating. However, the second surface 74 may contain a sealant, if desired. The reason that the second surface 74 is void of any printing, coloring or coating is that the second surface 74 will eventually form the interior surface of the discrete pouches 12 and a portion of the second or interior surface 74 will need to be bonded to another interior portion of the web of material 68. The absence of any printing, coating or coloring will facilitate bonding. Those skilled in the art will recognize that, especially for plastic and thermoplastic material, the absence of any printing, coloring or coating is usually a requirement in order to be able to form a good bond. This is especially true if heat and pressure are being used to form the bond.

The web of material 68 advancing through the machine 10 also has a first side edge 76 and an opposite, second side edge 78. The web of material 68 has a width w extending perpendicular between the first and second side edges, 76 and 78 respectively. The width w can vary. Desirably, the width w is less than about 4 feet. More desirably, the width w is less than about 3.5 feet. More desirably, the width w is less than about 3 feet.

Referring again to FIG. 1, the relatively flat web of material 68 is advanced to a first dancer 80 having a draw nip (not shown). The first dancer 80 can be a horizontal dancer or any other form of dancer. The first dancer 80 is capable of continuously adjusting the advancement of the web of material 68 such that the material 68 can make a transition from continuous motion, as it leaves the supply roll 70, to intermittent motion. Those skilled in art of manufacturing machines will be familiar with the function and operation of the dancer 80. The dancer 80 can contain a plurality of vertically movable, cylindrical rolls around which the web of material 68 flows in a serpentine fashion. The cylindrical rolls are capable of constantly changing their vertical position with respect to one another such that the incoming material 68 can make the transition from a continuous motion to an intermittent motion.

Still referring to FIG. 1, located downstream from the first dancer 80 and from the unwind station 66, as the web of material 68 moves in the machine direction (MD), is a punch station 82. The punch station 82 is capable of punching a predetermined pattern 84 through the web 66. Alternatively, the predetermined pattern 84 can be cut using equipment other than a punch. The punch station 82 can include one or more punch units 86 each capable of punching the particular pattern 84 through the web of material 68. In FIG. 1, two punch units 86, 86 are depicted. Each of the punch units 86, 86 can be identical or different. For example, each of the punch units 86, 86 can punch a portion of the overall predetermined pattern 84. Alternatively, the first of the punch units 86 can punch out the entire pattern 84 and the second or subsequent punch unit(s) 86 can provide a trim punch to make sure the predetermined pattern 84 is crisp, sharp and registered correctly in the advancing web of material 68.

Referring again to FIG. 7, the predetermined pattern 84 is repeated at a predetermined dimension b through the web of material 68. The dimension b is measured parallel to the machine direction (MD) of the web of material 68. The dimension b can vary depending upon the size of the discrete pouches 12 one desires to manufacture. The predetermined pattern 84 can also vary in configuration. A configuration 88 illustrates but one of an infinite variety of configurations that one can punch in the web of material 68. As illustrated, the configuration 88 includes a pair of spaced apart, approximately C-shaped configurations 88, 88 formed across the width w of the web of material 68. Even though a pair of approximately C-shaped configurations 88, 88 is shown, it should be understood that the predetermined pattern 84 can consist of one or more configurations, each having a desired profile.

It should be understood that when two or more configurations are present, that one configuration can be different from another configuration.

Each of the pair of approximately C-shaped configurations 88, 88 will form an upper end of one of the gussets 22 in the finished discrete pouches 12. The gussets 22, 22 are formed at the sides 18 and 20 of each of the discrete pouches 12. If the design of the discrete pouches 12 does not include gussets 22, 22 then the predetermined pattern 84 would not have to be punched out of the web of material 68.

Still referring to FIG. 7, each of the pair of approximately C-shaped configurations 88, 88 is aligned along a common centerline a-a. Each of the centerlines a-a is aligned perpendicular to the machine direction (MD). Of the pair of approximately C-shaped configurations 88, 88 located along each of the centerlines a-a, one of the approximately C-shaped configurations 88, 88 is spaced apart from the first side edge 76 by a dimension c. The dimension c can vary. Desirably, the dimension c is less than about 1 inch so as to reduce trim waste. The other approximately C-shaped configuration 88 is spaced apart from the second side edge 78 by a dimension d. The dimension d can vary. Desirably, the dimension d is several inches. In FIG. 7, the dimension d is greater than the dimension c. Furthermore, the pair of configuration 88, 88 is separated by a distance e. The dimension e can vary. Desirably, the dimension e is usually several inches in length. The dimension e will range from between about 90% to about 99% of a face width $w_1$, of each of the finished, discrete pouches 12. Desirably, the dimension e will range from between about 95% to about 99% of the face width $w_1$ of each of the finished, discrete pouches 12. By "face width" it is meant the width $w_1$ measured perpendicular between the sides 18 and 20 of the first major surface 14 of each of the finished, discrete pouches 12. The face width $w_1$ is usually less than half of the width w of the web of material 68.

Each of the pair of approximately C-shaped configurations 88, 88 has a base member 90 with two spaced apart legs 92 and 94. The legs 92 and 94 extend outward from the ends of the base member 90 in the machine direction (MD). The base member 90 has a dimension or length f measured parallel to the centerline a-a. The dimension f can vary but is usually several inches in length. For example, for a discrete pouch 12 having a face width $w_1$ of about 16 inches, the dimension f of the base member 90 can range from between about 4 inches to about 10 inches. More desirably, for a discrete pouch 12 having a face width $w_1$ of about 16 inches, the dimension f of the base member 90 can range from between about 6 inches to about 9 inches. The two legs 92 and 94 are aligned approximately parallel to one another and approximately parallel to the machine direction (MD). The two legs 92 and 94 can be aligned perpendicular to the base member 90 or be oriented at an angle thereto. Desirably, the two legs 92 and 94 are aligned perpendicular to the base member 90. The dimension of each leg 92 and 94 can vary. Desirably, each leg 92 and 94 has the same dimension. Each of the two legs 92 and 94 extend outward from an end of the base member 90 in a downstream fashion. The overall size of base member 90 and each of the two spaced apart legs 92 and 94 can vary but will be sized to correspond to a particular size discrete pouch 12. For example, the overall size of each of the pair of approximately C-shaped configurations 88, 88 can become larger as the size of the discrete pouches 12 get larger.

In FIG. 7, the dimension or length f of the base member 90 is sized such that it can be folded half way along the length f to form a pair of gussets 22, 22. Each of the gussets 22, 22 will have a width equal to or less than about half of the dimension f.

One will also notice that a pair of small apertures or holes 96, 96 are punched through the web of material 68 adjacent to the base member 90 of each of the pair of configurations 88, 88. These apertures 96, 96 are optional and can vary in size and shape. Desirably, the apertures 96, 96 are circular in shape and having a diameter of at least about 0.1 inches. Desirably, each aperture 96 has a minimum dimension which ranges from between about 0.1 inches to about 1.5 inches. The presence of the pair of apertures 96, 96 makes it easier to form bonds between various portions of the interior surface of the discrete pouches 12. This is especially true at those areas where the gussets 22, 22 are located. This will be explained in greater detail below when discussing the process.

Returning to FIG. 1, the web of material 68 is advanced downstream from the punch station 82 to a second dancer 98. The second dancer 98 can be equipped with a draw nip (not shown). The second dancer 98 can also be a vertical dancer like the first dancer 80 or it can be any other kind of dancer. The second dancer 98 can be identical to the first dancer 80. The second dancer 98 is capable of continuously adjusting the advancement of the web of material 68 such that the web 68 can make a transition from the intermittent motion that it has as it leaves the punch station 82, back to a continuous motion.

Still referring to FIG. 1, located downstream of the second dancer 98 and downstream of the punch station 82 is a folding station 100. The folding station 100 is capable of folding the web of material 68 upon itself such that the first surface 72 forms the exterior of the finished, discrete pouches 12, and the second surface 74 forms the interior of the finished, discrete pouches 12. The folding station 100 can include various stationary or movable components such as bars, plates, moveable fingers, etc. which can fold the web of material 68 into a desired configuration. Such folding machines are well known to those skilled in the art.

Referring to FIGS. 8-11, the web of material 68 is shown with six fold lines 102, 104, 106, 108, 110 and 112 shown as dashed lines. Each of the fold lines 102, 104, 106, 108, 110 and 112 are aligned parallel to one another and also are aligned parallel to the machine direction (MD) of the advancing web of material 68. Desirably, the six fold lines 102, 104, 106, 108, 110 and 112 are aligned parallel to the first and/or second side edges, 76 and 78 respectively. The web of material 68 is folded at the three fold lines 102, 104 and 106 to form a gusset 22 at the side 18, see FIG. 2. The web of material 68 is also folded at the three fold lines 108, 110 and 112 to form a gusset 22 at the opposite side 20, see FIG. 2. In addition, the web of material 68 is folded in half upon itself at fold lines 108 and 112 to form a folded web 114, see FIGS. 9-11.

Once the web of material 68 is folded upon itself, the predetermined pattern 84, which can consist of one or more cuts, is present in both the first and second major surfaces, 14 and 16 respectively. The predetermined pattern 84 formed in the first and second major surfaces, 14 and 16 respectively, has a contiguous boundary.

Referring again to FIG. 1 the folded web 114 is then advanced through a third dancer 116. The third dancer 116 does not include a draw nip. The third dancer 116 can be a horizontal dancer or any other form of dancer. Desirably, the third dancer 116 is a horizontal dancer. The third dancer 116 is capable of adjusting the advancement of the folded web 114 such that the folded web 114 can make a transition from continuous motion, as it leaves the folding station 100, back to an intermittent motion. Located downstream of the third dancer 116 is a draw mechanism 118 which includes a pair of draw rolls (not shown) having a nip formed therebetween. The draw mechanism 118 functions to advance the folded web 112 into a bonding station 120.

Referring again to FIG. 1, the bonding station 120 is located downstream from the folding station 100 and from the third dancer 116. The bonding station 120 can include one or more bonding units 122. Two spaced apart bonding units 122 are depicted. Each bonding unit 122 is aligned parallel to the machine direction (MD).

Figure 12:
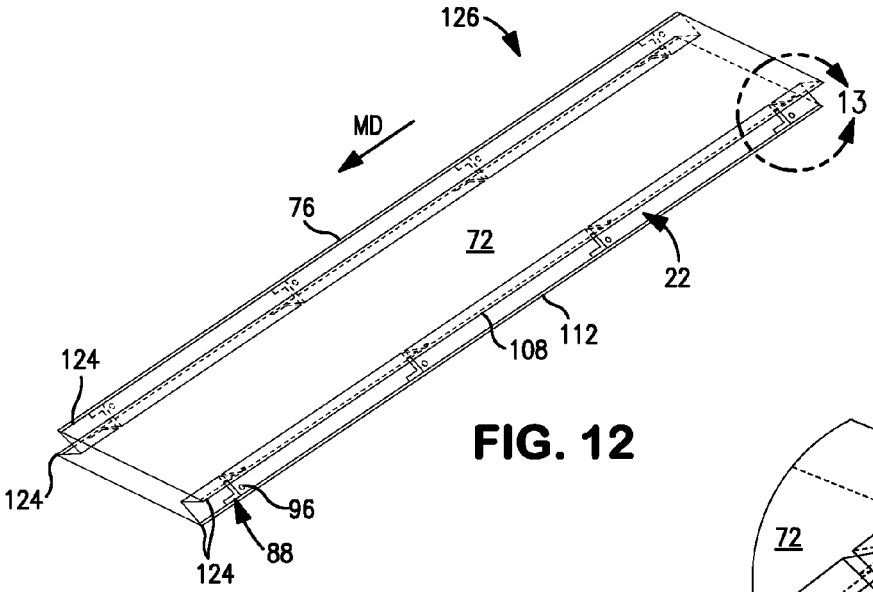
FIG. 12 is a perspective view of a continuous tubular structure once the web of material is bonded together.
Figure 13:
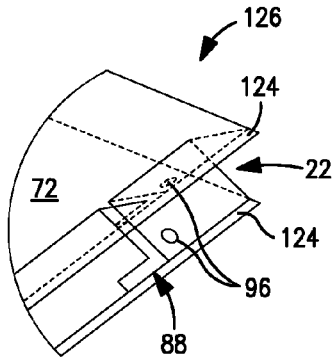
FIG. 13 is an enlarged view of a portion of FIG. 12 showing a gusset.
Figure 14:
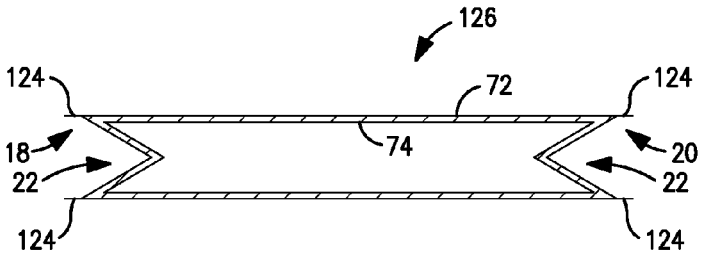
FIG. 14 is an end view of the tubular structure shown in FIG. 12 after four bonds have been formed.

Referring now to FIGS. 12-14, each of the bonding units 122 is capable of forming one or more spaced apart bonds 124 in the overlapped material. Four longitudinal bonds 124 are depicted adjacent to the fold lines 102, 106, 108 and 112. Each of the four bonds 124, 124, 124 and 124 can be continuous or intermittent. Desirably, each of the four bonds 124, 124, 124 and 124 is a continuous bond. To facilitate a good bond, the second surface 74 should not be printed, colored, coated or contain any substance which could interfere with establishing a good strong bond. Once the four bonds 124, 124, 124 and 124 are formed, a continuous tubular structure 126 is formed. The four bonds 124, 124, 124 and 124 can be located approximate each of the four corners of the tubular structure 126. In the tubular structure 126, two of the bonds 124, 124 are formed adjacent to the side 18 and the remaining two bonds 124, 124 are formed adjacent to the side 20 of the finished, discrete pouch 12. Each of the bonds 124, 124, 124 and 124 can be formed by using heat, pressure, heat and pressure, ultrasonics, adhesive, glue, a co-adhesive, double sided tape, etc. In addition, each of the bonds 124, 124, 124 and 124 could be created by using a chemical bonding agent. A combination of heat, pressure and/or a chemical bonding agent can also be utilized. Desirably, each of the four bonds 124, 124, 124 and 124 are formed by using a combination of heat and pressure. The four bonds 124, 124, 124 and 124 secure a portion of the second surface 74 to another portion of the second surface 74. The apertures 96, 96 which were punched in the web of material 68 provide a means by which a portion of the second surface 74 can be secured to another portion of the second surface 74 in the vicinity of each of the gussets 22, 22. At each of the folded sides 18 and 20 where the gussets 22, 22 are located, there are four layers of material. The apertures 96, 96 permit the first major surface 14 to be directly bonded to the second major surface 16, see FIG. 2. Those skilled in the bonding art will know of the kind of equipment needed in order to form the bonds 124, 124, 124 and 124.

Figure 15:
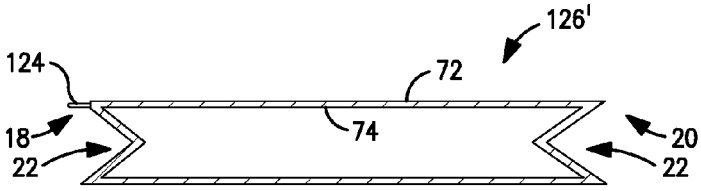
FIG. 15 is an end view of an alternative embodiment of a tubular structure having a single longitudinal bond.

Referring to FIG. 15, an alternative embodiment is depicted showing a continuous tubular structure 126' wherein a single bond 124 is formed at or adjacent to the fold line 102. The bond 124 is formed only at the side 18 of the finished discrete pouch 12.

Referring again to FIG. 1, when a thermal bond is utilized, a certain amount of heat will be generated which will be retained by the surrounding material. Depending upon the material from which the pouch 12 is constructed, it may be advantageous to cool the material in which the bonds 124, 124, 124 and 124 have been formed so as to prevent the material from becoming deformed or damaged or to give the material a textured pattern. This is especially true when the material is a polyolefin, such as polyethylene or polypropylene. If too much heat is present or if the heat is maintained for an extended period of time from the bonding step, the material could melt and through holes could develop in the tubular structure 126 or 126'. This is detrimental to the finished pouch 12 and must be avoided. One way to dissipate or remove the heat that may be present from the bonding step is to advance the continuous tubular web 126 or 126' downstream to a cooling station 128. In FIG. 1, the cooling station 128 includes a pair of spaced apart cooling units 130, 130 which are coaxially aligned with the bonding units 122, 122. The cooling units 130, 130 are aligned parallel with the machine direction (MD). The cooling units 130, 130 are spaced apart approximately the same distance as the bonding units 122, 122 so that they can cool the same region of the material of the folded web 114 that was heated by the bonding units 122, 122.

It should be understood that if the bonding station 120 does not generate any heat or does not generate a sufficient amount of heat that needs to be removed, then the cooling station 128 would not be needed.

Referring again to FIG. 1, a draw unit 132 is shown located downstream of both the cooling station 128 and the bonding station 120. The draw unit 132 includes a pair of draw rolls (not shown) with a nip formed therebetween. The draw unit 132 functions to advance the tubular structure 126 or 126' through a sealing station 134. Those skilled in the art will recognize that the draw unit 132 could possibly be located downstream of the sealing station 134, if desired. For some applications, it may be possible to eliminate the draw unit 132 completely. However, as indicated in FIG. 1, the draw unit 132 functions to advance the tubular structure 126 or 126' in an intermittent fashion.

Figure 16:
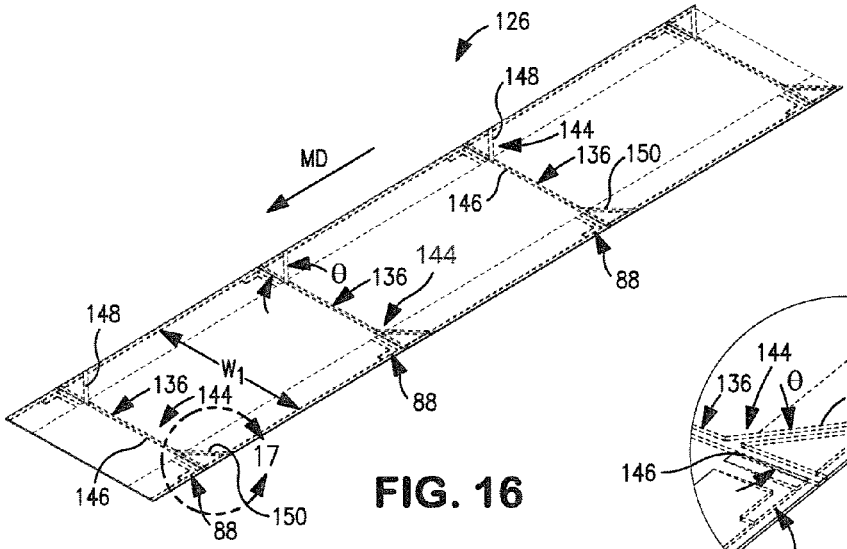
FIG. 16 is a perspective view of the continuous tubular structure with a transverse seal formed therein.
Figure 17:
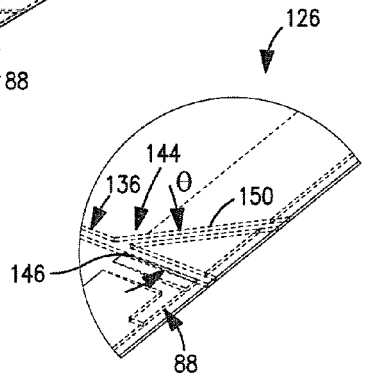
FIG. 17 is an enlarged view of a portion of FIG. 16 showing one end of the transverse seal.

Referring now to FIGS. 1, 16 and 17, the sealing station 134 is located downstream from the bonding station 120. The sealing station 134 is capable of forming one or more seals 136, see FIGS. 16 and 17 in the tubular structure 126 or 126'. The size, shape and location of the seals 136 can vary. Desirably, one of the seals 136 will extend transversely across the continuous tubular structure 126 or 126'. The seals 136 can be formed adjacent to and upstream of each pair of the configurations 88, 88. The sealing station 134 can include one or more sealing units arranged downstream from one another. In FIG. 1, three sealing units 138, 140 and 142 are depicted. The three sealing units 138, 140 and 142 can apply heat, a combination of heat and pressure, or some other sealing process to form one or more of the seals 136 in the tubular structure 126 or 126'. The temperature of the three sealing units 138, 140 and 142 can range from between about 100° Fahrenheit (F) to about 600° F. Desirably, the temperature of the sealing units 138, 140 and 142 can range from between about 200° F. to about 500° F. More desirably, the temperature of the sealing units 138, 140 and 142 is at least about 300° F.

Referring to FIGS. 16 and 17, a particular configuration for the seal 136 will be taught. However, it should be recognized that this invention is not limited to this particular seal 136 configuration.

The first sealing unit 138 can form an approximately K-shaped seal 144 or a portion of an approximately K-shaped seal 144 transversely across the tubular structure 126 or 126'. The actual construction of the approximately K-shaped seal 144 includes an elongated segment 146 and two shorter segments 148 and 150. The elongated segment 146 and the two shorter segments 148 and 150 can all vary in shape but desirably they are either linear or curvilinear. Most desirably, they are all linear. The elongated segment 146 spans transversely across a portion of or across the entire face width $w_1$ of the tubular structure 126 or 126'. Desirably, the elongated segment 146 spans completely across the face width $w_1$ and is aligned perpendicular to the machine direction (MD). The elongated segment 146 can vary in width and depth but should form a sufficiently strong seal capable of permanently sealing the first major surface 14 to the second major surface 16, see FIG. 2. The two shorter segments 148 and 150 are angled outward from the elongated segment 146 to form an approximately K-shape seal 144. The two shorter segments 148 and 150 are shown angling upstream from the elongated segment 146 such that they extend away from the closed bottom 24. The exact angle theta θ that each of the shorter segments 148 and 150 are arranged relative to the elongated segment 146 can vary. The angle θ can range from between about 5 degrees to about 75 degrees. Desirably, the angle θ is less than about 60 degrees. More desirably, the angle θ is less than about 45 degrees. Each of the two shorter segments 148 and 150 intersect with one of the sides 18 and 20.

It should be understood that the discrete pouches 12 can be designed to have only a single seal that is either linear or arcuate in configuration. In fact, the seal 136 can be of any desired geometrical shape. The approximately K-shaped seal 144 produces a much stronger seal and is advantageous when the discrete pouches 12 are large, for example when the discrete pouches have a face width $w_1$ of 16 inches or more, and a height of 18 inches or more. Discrete pouches 12 size to retain pet food and having a total weight of 10 pounds or more represent a good example of when the approximately K-shaped seal 144 can be advantageously employed.

Referring again to FIG. 1, all three of the sealing units 138, 140 and 142 can be utilized to form the approximately K-shaped seal 144. This can be accomplished by have each of the three sealing units 138, 140 and 142 form a portion of the approximately K-shaped seal 144. Alternatively, the sealing unit 138 can form the complete approximately K-shaped seal 144 and the sealing units 140 and 142 can create a deeper and more pronounced seal 144. Desirably, all three of the sealing units 138, 140 and 142 form a portion of the approximately K-shaped seal 144 such that after the three sealing units 138, 140 and 142, the approximately K-shaped seal 144 is completely formed.

Figure 18:
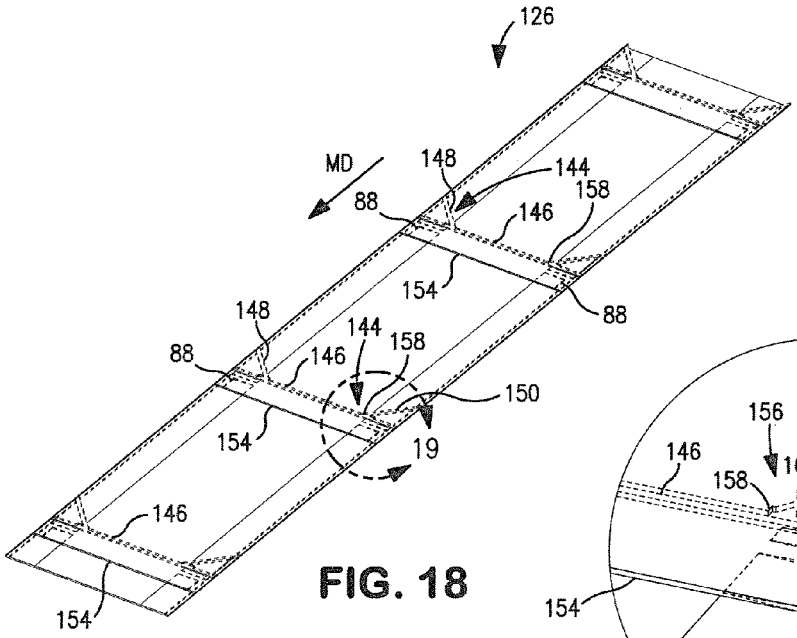
FIG. 18 is a perspective view of the continuous tubular structure with a crease and a stomp seal formed therein.
Figure 19:
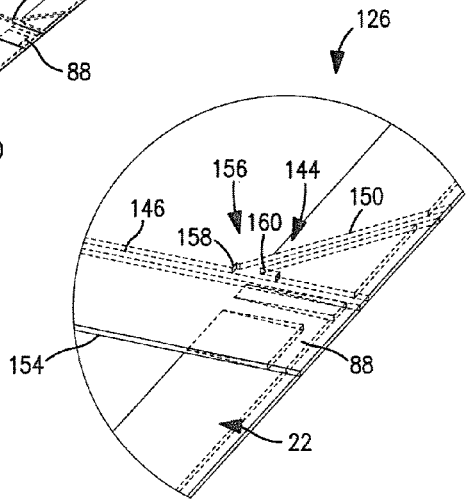
FIG. 19 is an enlarged view of a portion of FIG. 18 showing the crease and the stomp seal.

Referring again to FIGS. 1, 18 and 19, a crease and stomp seal unit 152 is located downstream of the sealing units 138, 140 and 142. The crease and stomp seal unit 152 is capable of forming a crease 154, see FIG. 18, transversely across the tubular structure 126 or 126'. Simultaneously or sequentially, the crease and stomp seal unit 152 is capable of forming a stomp seal 156 onto the approximately K-shaped seal 144. The stomp seal 156 forms two small notches 158 and 160 approximate the location where each of the shorter segments 148 and 150 intersect with the elongated linear seal 146. The purpose of the stomp seal 156 is to crimp the first and second major surfaces 14 and 16 so as to prevent products housed in the discrete pouch 12 from escaping or leaking out. This is important when a liquid or a small granular product is stored in the discrete pouch 12. The stomp seal 156 functions to reinforce the two lower corners of the finished discrete pouch 12. The stomp seal 156 may not be required in all applications. For example, if large items or articles are to be stored in the discrete pouches 12, one may not need to reinforce the corners of the discrete pouches 12 because such items or articles cannot escape or leak out.

Referring again to FIG. 1, two cooling units 162 and 164 are located downstream of the crease and stomp seal unit 152 and also downstream of the sealing units 138, 140 and 142. The cooling unit 164 is located downstream of the cooling unit 162. The cooling units 162 and 164 function to cool the approximately K-shaped seal 144 and the stomp seal 156 formed in the tubular structure 126 or 126'. It should be noted that the cooling units 162 and 164 can be eliminated if they are not needed. When present, the cooling units 162 and 164 can reduce the temperature of the material where the seals 144 and 152 were formed down to less than about 100° F., and desirably, down to around room temperature.

The sealing station 134 can be viewed as including the three sealing units 138, 140 and 142, the crease and stomp seal apparatus 152, and the two cooling units 162 and 164.

Referring again to FIG. 1, a punch unit 166 is located downstream of the cooling units 162 and 164 and the crease and stomp unit 152. The punch unit 166 can include a pair of punches 168 and 170 spaced apart from one another. The pair of punches 168 and 170 can be aligned opposite to one another so that they can punch opposite sides of the tubular structure 126 or 126'.

Figure 20:
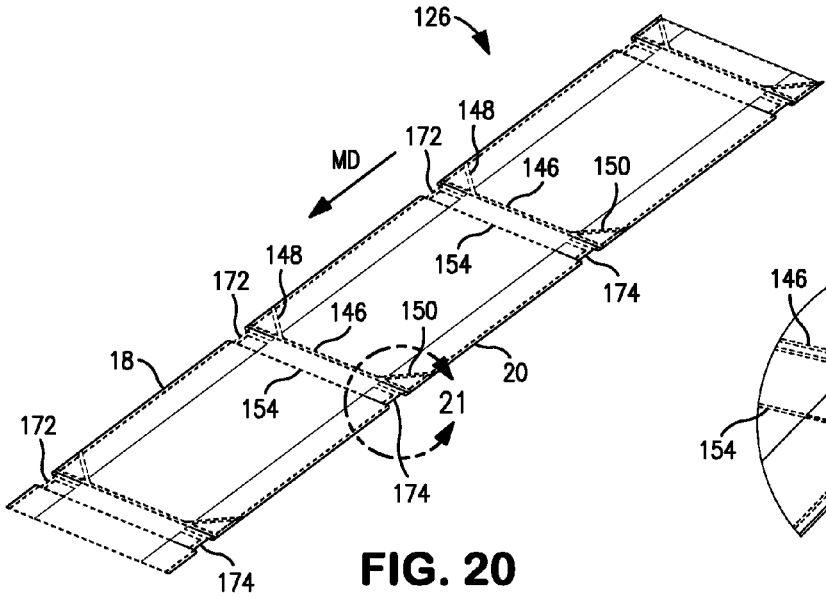
FIG. 20 is a perspective view of the continuous tubular structure after being subjected to another punch.
Figure 21:
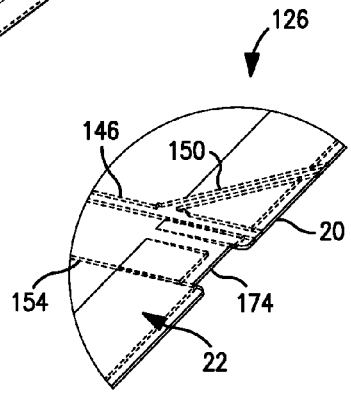
FIG. 21 is an enlarged view of a portion of FIG. 20 showing the punched section.

Referring now to FIGS. 20 and 21, the pair of punches 168 and 170 can form a pair of notches 172 and 174 in the tubular structure 126 or 126'. The notch 172 is formed adjacent to the side 18 and the notch 174 is formed adjacent to the side 20. The size and shape of each of the notches 172 and 174 can vary. Desirably, both notches 172 and 174 are of the same size and configuration. As depicted, the two notches 172 and 174 have a rectangular configuration but could have some other configuration, if desired.

Referring again to FIG. 1, the tubular structure 126 or 126' is advanced past a slitting station 176. The slitting station 176 is located downstream of the punch unit 166 and downstream of the sealing station 134. The slitting station 176 can be a servo cut-off knife, a rotary knife, or any other kind of cutting apparatus known to those skilled in the art.

Figure 22:
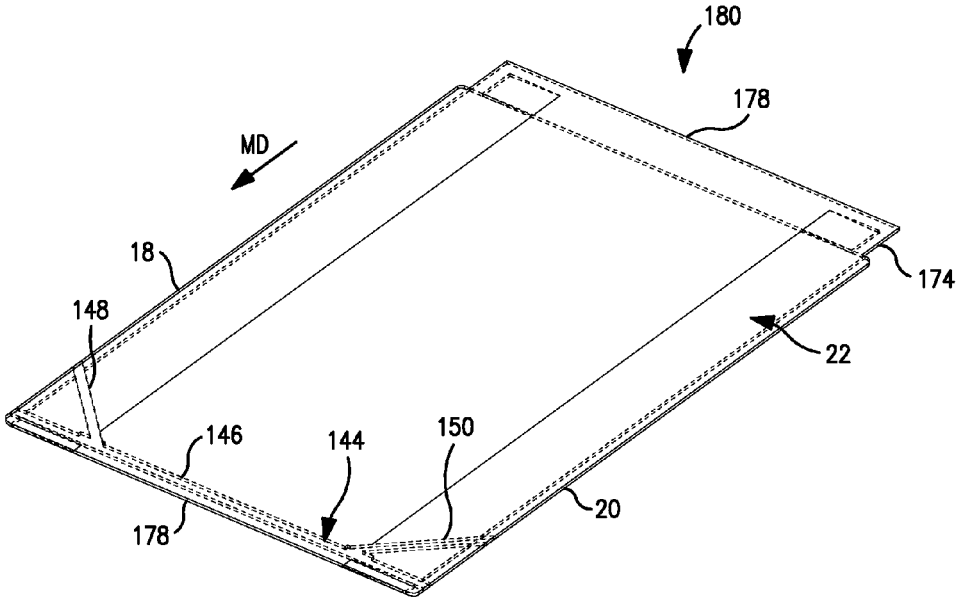
FIG. 22 is a perspective view of a discrete pouch after it has been slit or cut from the continuous web.

Referring now to FIG. 22, the slitting station 176 is capable of forming a slit or cut 178 transversely across the continuous tubular structure 126 or 126'. The slit or cut 178 occurs at the locations, depicted in FIG. 22, which is at or adjacent to the elongated linear seal 146. The slitting station 176 slits, cuts or severs the continuous tubular structure 126 or 126' into a plurality of the discrete articles 180. A multiplicity of discrete articles 180 can be formed from the tubular structure 126 or 126'. Since the machine 10 is an in-line manufacturing process, the speed at which the discrete articles 180 can be manufactured is rather high.

Referring again to FIG. 1, a rearward portion 182 of the machine 10 is shown. This rearward portion 182 can be assembled in-line with one or more of the upstream portions 82, 100, 122 and 134 of the machine 10 as shown. Alternatively, the rearward portion 182 can be a standalone segment which is separated from the remainder of the machine 10. Desirably, the rearward portion 182 is in-line and attached to the upstream portion 134 of the machine 10. The rearward portion 182 includes a first station 184 which is capable of receiving and advancing each of the discrete articles 180 in the machine direction (MD). The first station 184 can be operated at a speed that is equal to or different from the speed of the upstream sealing station 134. Desirably, the first station 184 is operated at a speed that is faster than the speed of the sealing station 134. By running the first station 184 at a faster speed than the sealing station 134, one can be assured that the discrete articles 180 are moved away from the advancing continuous tubular structure 126 or 126' which is being slit at the slitting station 176.

Figure 23:
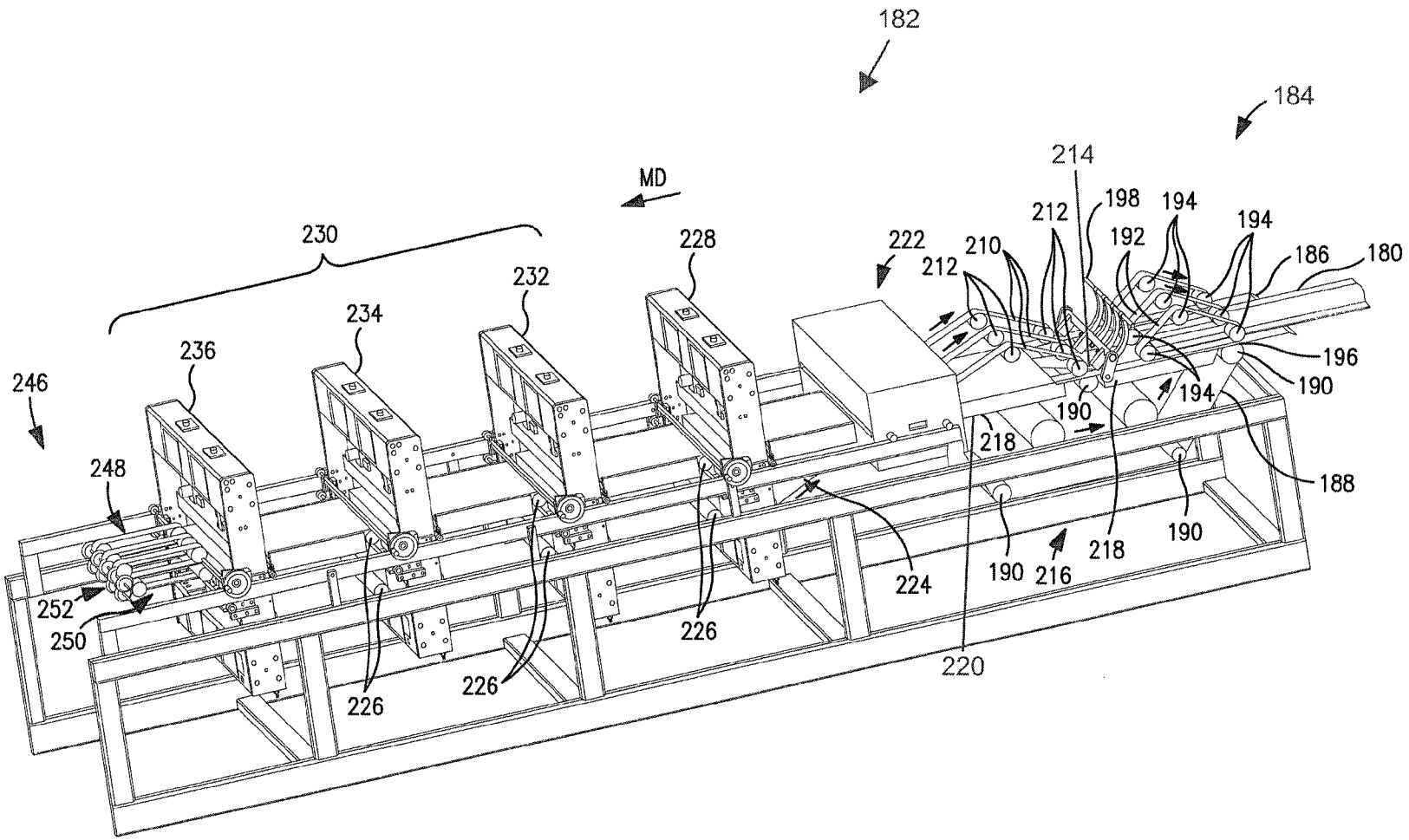
FIG. 23 is a perspective view of a rearward portion of the machine.

Referring now to FIG. 23, the first station 184 includes a stationary plate 186 which serves as an entry point for the discrete articles 180. The stationary plate 186 is relatively flat and is aligned horizontally so as to provide support for each of the discrete articles 180. Positioned in axially alignment and downstream of the stationary plate 186 is a first continuous belt 188 that rotates around a plurality of spaced apart rollers 190. The exact number of rollers 190 can vary depending upon the length of the continuous belt 188 and the path of the continuous belt 188. The first continuous belt 188 can run along the entire first station 184, as shown, or it could extend along the greater length of the rearward portion 182 of the machine 10. Desirably, the first continuous belt 188 will run along the length of the first station 184. The first continuous belt 188 is shown moving in a counter clockwise direction since the machine direction (MD) is from right to left. The first continuous belt 188 will serve as a movable platform for each of the discrete articles 180 as they advance through the first station 184.

The first continuous belt 188 can have a width that is equal to or greater than the face width $w_1$ of each of the discrete pouches 12, see FIG. 2. Desirably, the width of the first conveyor belt 188 is wider than the face width $w_1$ of each of the discrete pouches 12. More desirably, the width of the first conveyor belt 188 is at least 4 inches wider than the face width $w_1$ of each of the discrete pouches 12. The first continuous belt 188 functions to support the lower surface of each of the discrete articles 180 as they advance through the first station 184.

Still referring to FIG. 23, the first station 184 also includes first upper belts 192 which are continuous and are movable around a plurality of spaced apart rollers 194. Three first upper belts 192 are depicted in FIG. 23. It should be understood that one, two, three or more of the first upper belts 192 can be utilized depending upon the face width $w_1$ of the finished discrete pouch 12. Each of the first upper belts 192 can have a width ranging from between about 1 inch to about 6 inches. Desirably, each of the first upper belts 192 has a width ranging from between about 1.5 inches to about 3 inches. Each of the first upper belts 192 is spaced apart from an adjacent belt 192 and the first upper belts 192 can be aligned parallel to one another. The first upper belts 192 rotate in a clockwise direction.

The number of rollers 194 around which the first upper belts 192 rotate can vary depending upon the size and configuration of the first upper belts 192. The first upper belts 192 cooperates with the first continuous belt 188 to form a nip 196 therebetween through which each of the discrete articles 180 can be advanced. The speed of the first upper belts 192 can be adjusted to match the speed of the continuous belt 188.

Referring back to FIG. 22, each of the discrete articles 180 can be advanced through the rearward portion 182 of the machine 10 with its K-shaped seal 144 serving as the leading edge. In this orientation, the sides 18 and 20 are aligned parallel or approximately parallel to the machine direction (MD). In other words, the closed bottom 24 of each finished discrete pouch 12, see FIG. 2, will lead the discrete article 180 through the machine 10. It is important in attaching the closure system 28 to each of the discrete articles 180 that the sides 18 and 20 are aligned parallel or approximately parallel to the machine direction (MD). Alternatively, each of the discrete articles 180 can be advanced through the rearward portion 182 of the machine 10 with the open top 26, see FIG. 2, or the unsealed end being the leading edge. This is a very unique aspect of the machine 10. Up until now, applicants do not know of any machine that has the ability to feed a discrete article 180, in the machine direction (MD), through the machine 10 with either the closed end 24 or the open end 26 serving as the lead.

Referring now to FIGS. 1, 2 and 24-25, the first station 184 also includes a number of fingers 198, which are capable of lifting and folding a portion of the first major surface 14 upon itself to form a lip 200. The number of fingers 198 can vary. The fingers 198 can be spaced apart from one another and can be aligned parallel to one another. There should be a sufficient number of fingers 198 to extend across the face width $w_1$ of the discrete pouch 12. Desirably, there are at least two spaced apart fingers 198 which extend across the face width $w_1$ of the discrete pouch 12. More desirably, there are at least three spaced apart fingers 198 which extend across the face width $w_1$ of the discrete pouch 12. Even more desirably, there are at least four spaced apart fingers 198 which extend across the face width $w_1$ of the discrete pouch 12.

It should be understood by those skilled in the art that the fingers 198 could be replaced by some other mechanism that can accomplish the same function. For example, the fingers 198 could be replaced by one or more vacuum bars, rotary brushes, static pinners, etc, or by some combination thereof.

Figure 24:
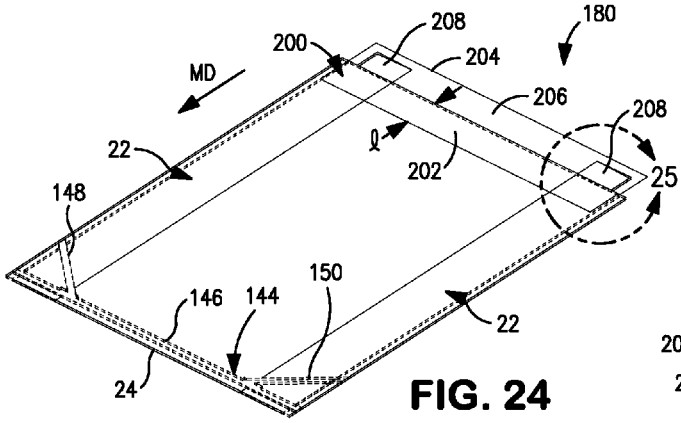
FIG. 24 is a perspective view of the discrete article shown in FIG. 22 after the lip has been folded back upon itself.
Figure 25:
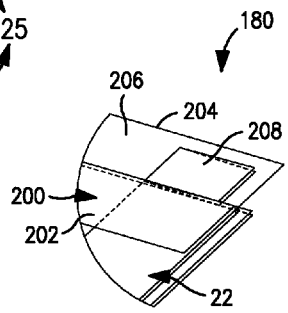
FIG. 25 is an enlarged view of a portion of FIG. 24 showing the lip being folded back and exposing the inside of the second major surface.

In FIGS. 24 and 25, the lip 200 is shown being aligned approximately perpendicular to the machine direction (MD). The lip 200 has a length l, measured parallel to the machine direction (MD), which ranges from between about 0.25 inches to about 4 inches. Desirably, the length l of the lip 200 ranges from between about 0.5 inches to about 3 inches. More desirably, the length l of the lip 200 ranges from between about 0.75 inches to about 2 inches. As the material which forms the lip 200 is folded, a first surface 202 of the lip 200 faces upward and is exposed. The exposed first surface 202 is a portion of the interior of the first major surface 14. The exposed first surface 202 should not contain any printing, coloring or coating thereon. The lip 200 is distally spaced from a transverse edge 204 of the second major surface 16 which forms the discrete article 180. The second major surface 16 also has an inner surface 206 which is located adjacent to the transverse edge 204. The inner surface 206 faces upward and is exposed. The exposed inner surface 206 also should not contain any printing, coloring or coating thereon. Furthermore, as the lip 200 is formed, the inside surfaces 208, 208 of each of the gussets 22, 22 face upward and are exposed. These surfaces 208, 208 also should not contain any printing, coloring or coating thereon.

Referring again to FIGS. 1 and 23, the first station 184 further includes second upper belts 210 which are continuous and are movable around a plurality of spaced apart rollers 212. Like the first upper belts 192, the second upper belts 210 can be aligned parallel to one another and be spaced apart from one another. Three of the second upper belts 210 are depicted In FIGS. 1 and 23. However, the exact number of the second upper belts 210 that are utilized can vary. One, two, three or more of the second upper belts 210 can be present. The face width $w_1$ of the finished discrete pouches 12 will partially determine how many of the second upper belts 210 are needed. The second upper belts 210 move in a clockwise direction.

The number of rollers 212 needed can vary depending on the size and configuration of the second upper belts 210. The second upper belts 210 cooperate with the continuous belt 188 to form a nip 214 through which each of the discrete articles 180 can be advanced after leaving the fingers 198. The second upper belts 210 can be similar or identical to the first upper belts 192. The second upper belts 210 are located downstream of the fingers 198. Each of the second upper belts 210 can have a width ranging from between about 1 inch to about 6 inches. Desirably, the width of each of the second upper belts 210 ranges from between about 1.5 inches to about 3 inches. The speed of the second upper belts 210 can be adjusted to match the speed of the continuous belt 188. Desirably, the first upper belts 192, the second upper belts 210 and the continuous belt 188 all move at the same speed.

Referring again to FIG. 23, the first station 184 also has a vacuum section 216 located beneath the first station 184. The vacuum section 216 can extend throughout the entire length of the first station 184. The vacuum section 216 includes one or more vacuum boxes 218 and one or more vacuum plenums 220 located below the vacuum boxes 218. The size and shape of the two vacuum boxes 218, 218 and the two vacuum plenums 220, 220 can vary. The vacuum section 216 functions to hold the second major surface 16 of each of the discrete articles 180 securely against the continuous first conveyor belt 188 as the lip 200 is folded upon itself. The vacuum section 216 also functions to hold each of the discrete articles 180 such that the sides 18 and 20 are aligned parallel to the machine direction (MD). This allows the lip 200 to be folded perpendicular to the sides 18 and 20 such that the length l of the lip 200 remains constant. In other words, the lip 200 will not be skewed relative to the machine direction (MD).

Figure 26:
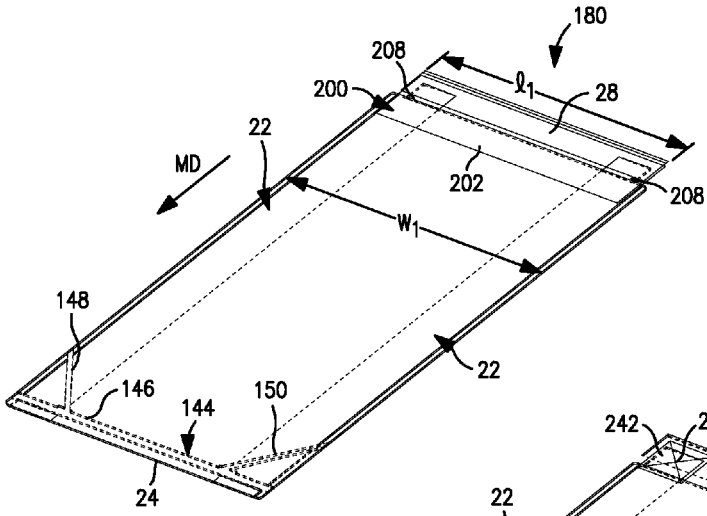
FIG. 26 is a perspective view of the discrete article shown in FIG. 24 after a closure system has been secured to the inner surface of the second major surface.
Figure 27:
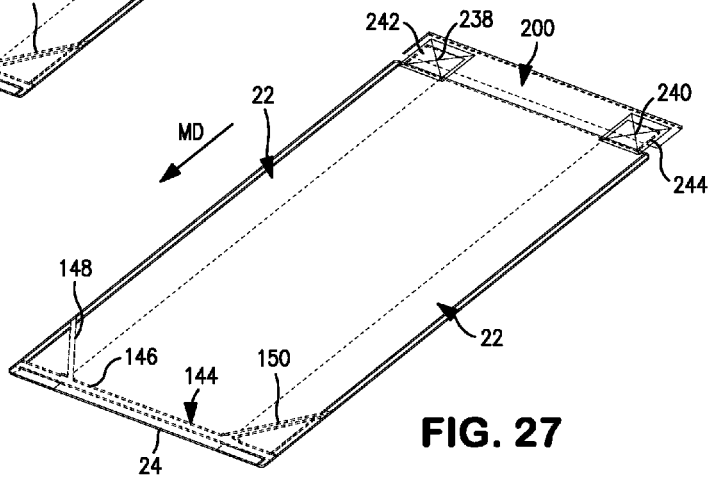
FIG. 27 is a perspective view of the discrete pouch shown in FIG. 26 after the lip is folded back and its ends are sealed.

Referring now to FIGS. 1, 23 and 26, the rearward portion 182 of the machine 10 also includes a second station 222 located downstream from the first station 184. The second station 222 is capable of positioning and attaching a closure system 28 transversely across the exposed inner surface 206 of the second major surface 16, adjacent to the transverse edge 204. The second station 222 is also capable of cutting the strip material which forms the closure system 28 to a desired length $l_1$ so that it has a length equal to the face width $w_1$ of the finished discrete pouch 12. The closure system 28 is secured in place as each of the discrete articles 180 advances in the machine direction (MD) at a predetermined speed. Alternatively, each of the discrete articles 180 can be temporarily halted as the closure system 28 is attached, although this will slow down the production process. Desirably, the closure system 28 is attached to each of the discrete articles 180 as each of the discrete articles 180 is intermittently moved through the rearward portion 182 of the machine 10. The second station 222 can be a commercially available unit from Illinois Tool Works Inc. of Glenview, Ill. The unit from Illinois Tool Works Inc. is designed to secure a zipper to an edge of a tubular structure or to a side of a discrete pouch but it can be modified to work with the present machine 10. U.S. Pat. Nos. 4,878,987; 4,909,017; 5,557,907 are just a few that teach securing a closure system, for example a zipper, onto a bag material. Those skilled in the art will be familiar with other closure systems and apparatuses which could be utilized with the present machine 10 with slight modifications.

Referring to FIGS. 3, 4 and 26, one way of securing or attaching the closure system 28 to each of the discrete articles 180 is to seal or bond the outer surface 38 of the second leg 34 of each of the closure systems 28 to the inner surface 206 of the second major surface 16, see FIG. 26. Desirably, the closure system 28 is initially in the form of a continuous strip of material that can be advanced across the face width $w_1$ of the discrete article 180 and then be cut to the required length $l_1$. Alternatively, the strip of material can first be secured or attached to the inner surface 206 before it is cut to the desired length $l_1$. The closure system 28 can be a typical zipper or any variation thereof. The closure system 28 can be secured or attached by using heat, pressure, heat and pressure, an ultrasonic bond, by using an adhesive, by using a co-adhesive, by using double sided tape, by using a combination of any of the above or by using some other bonding method known to those skilled in the bonding art. The closure system 28 could also be mechanically attached to the inner surface 206. Desirably, the closure system 28 is secured to the inner surface 206 by using heat and pressure. The amount of heat and pressure utilized will depend upon the materials from which the second major surface 16 and the closure system 28 are constructed of, the thickness of each material, the melting temperature of each material, etc.

When the closure system 28 is in the form of a zipper, it can be secured to the inner surface 206 of the second major surface 16 while the opening/closing mechanism 46 is in either the closed position, see FIG. 4, or in the open position, see FIG. 5. Desirably, the closure system 28 is secured to the inner surface 206 of the second major surface 16 while the opening/closing mechanism 46 is in the closed position. The slide member 52 can be positioned on the track 30 before, during or after the closure system 28 is secured to the inner surface 206 of the second major surface 16.

It should be recognized that the closure system 28 can be temporarily secured to the inner surface 206 or be permanently attached to the inner surface 206. If the closure system 28 is temporarily attached, then a second securement step will be needed to permanently attach the closure system 28 to the inner surface 206. Desirably, the closure system 28 will be permanently attached to the inner surface 206 in one step.

The location of the securement of the closure system 28 to the inner surface 206 and whether the securement is continuous or intermittent along the length of the closure system 28 can vary. For example, the securement can be a plurality of spot bonds, a continuous linear seal, an intermittent linear seal, etc. Desirably, the bond or securement will extend along essentially the entire inner surface 206 of the second major surface 16. More desirably, the securement of the closure system 28 to the inner surface 206 will be in the form of a continuous bond which extends along the entire length $l_1$ of the closure system 28.

It is to be understood that the length $l_1$ of the closure system 28 should be essentially equal to the face width $w_1$ of the discrete pouch 12. However, the length $l_1$ of the closure system 28 could be slightly less than the face width $w_1$ of the discrete pouch 12. For example, the length $l_1$ of the closure system 28 could be slightly less than the face width $w_1$ because of the material that was punched out of the continuous web of material 68. Desirably, the closure system 28 should be bonded or secured along its entire length $l_1$. Alternatively, the closure system 28 could be bonded or secured along essentially most of its length $l_1$.

It should be noted that the closure system 28 can be permanently secured to the inner surface 206 of the second major surface 16 at the second station 222. Alternatively, the closure system 28 can be temporarily secured to the inner surface 206 of the second major surface 16 at the second station 222 and then be permanently secured using additional sealing units. The use of additional sealing units is shown in FIG. 23.

Referring again to FIG. 23, the rearward portion 182 of the machine 10 includes a second conveyor belt 224 that rotates around a plurality of spaced apart rollers 226. The exact number of rollers 226 can vary depending upon the length of the second conveyor belt 224 and the travel path of the second continuous belt 224. The second conveyor belt 224 forms a continuous loop. The second conveyor belt 224 can be similar to the first conveyor belt 188. The second conveyor belt 224 extends downstream from the second station 222 to the end of the rearward portion 182. The second conveyor belt 224 is shown rotating in a counter clockwise direction and functions as a moving horizontal support for the discrete articles 180 as they advance through the remainder of the rearward portion 182.

Still referring to FIGS. 1 and 23, the rearward portion 182 also includes an optional sealing unit 228 located downstream of the second station 222. The sealing unit 228 is designed to permanently seal or bond the closure system 28 to the inner surface 206 of the second major surface 16 adjacent to the trailing end 204. The sealing unit 228 will not be needed if the second station 222 can form the permanent bond. When the sealing unit 228 is present, it can bond the closure system 28 to the inner surface 206 from the top, from the bottom or from both the top and the bottom. Desirably, the closure system 28 is bonded from both sides to the inner surface 206 in order to obtain a secure bond that extends completely along the entire length of the closure system 28.

It should also be understood that the seal or bond can be formed between the closure system 28 and the inner surface 206 of the second major surface 16 using different kinds of bonding equipment known to those skilled in the art.

Still referring to FIGS. 1, 5, 23 and 27, the rearward portion 182 of the machine 10 further includes a third station 230 located downstream from said second station 222 and downstream of the sealing unit 228 when it is present. The third station 230 includes an unfolding and seal unit 232, a sealing unit 234, and a cooling unit 236. The unfolding and seal unit 232 is capable of unfolding the lip 200 back to its initial unfolded orientation. In this orientation, the exposed first surface 202 is no longer exposed but instead now lies over and covers a major portion of the closure system 28. The unfolding and seal unit 232 is also capable of forming a pair of seals 238 and 240 at the opposite ends, 242 and 244, respectively, of the lip 200. The pair of seals 238 and 240 secure portions of the first surface 202 of the lip 200 to the closure system 28. In particular, the seals 238 and 240 secure portions of the first surface 202 of the lip 200 to the outer surface 42 of the second leg 34, see FIG. 5. The size of the pair of seals 238 and 240 can vary. The opposite ends 242 and 244 of the lip 200 can be sealed or bonded using any of the bonding techniques taught above. A hot seal or bond can be obtained by using heat or heat and pressure works fine. One can also use ultrasonics, an adhesive or a double sided tape to form the seals 238 and 240.

The opposite ends 242 and 244 of the lip 200 can be bonded or sealed to the closure system 28 from the top, from the bottom or from both the top and the bottom. Desirably, the opposite ends 242 and 244 are bonded or sealed to the closure system 28 from both sides in order to form a more secure seal.

The sealing unit 234 can apply additional heat or heat and pressure onto the seals 238 and 240 to insure that they are permanently formed. The sealing unit 234 is optional if the unfolding and seal unit 232 is capable of forming permanent seals 238 and 240. After the seals 238 and 240 are formed, the discrete articles 180 are subjected to the cooling unit 236. The cooling unit 236 cools the material which forms the discrete pouches 12 and the seals 238 and 240 down to or towards room temperature. Once the discrete articles 180 have been cooled, the discrete pouches 12 are finished.

Figure 28:
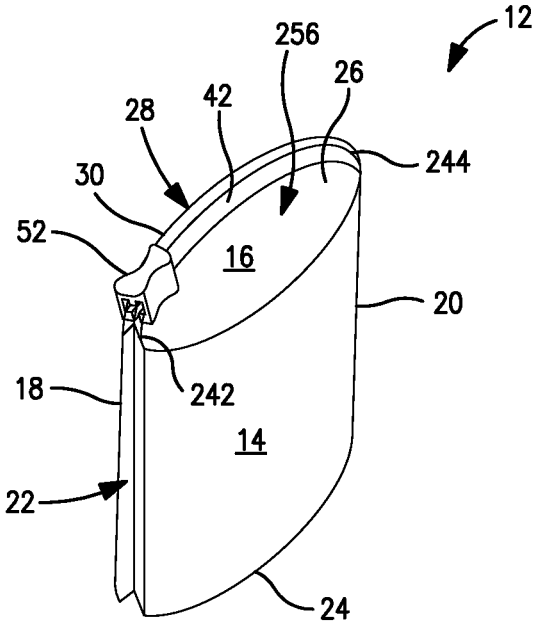
FIG. 28 is a perspective view of a discrete pouch having a closure system secured to its second major surface and having its sides manipulated to form an enlarged opening adjacent to the open top.

Referring now to FIG. 28, the discrete pouch 12 is shown after its sides 18 and 20 have been manipulated, such as being squeezed towards one another, so as to form an enlarged opening 256 adjacent to the open end 26. One will notice that the first major surface 14 of the discrete pouch 12 is not bonded to the closure system 28 along its entire length. Instead, the first major surface 14 is bonded only at the opposite ends 242 and 244 to the closure system 28. The distance between the pair of ends 242 and 244 is left unbounded and open. The reason for this is that the discrete pouches 12 can be quickly and rapidly filled with items, articles or products at a manufacturing site. Usually for a liquid product or for small granular products, the products can be dispensed into an empty pouch 12 via an injection or hopper system. Alternatively, the discrete pouches 12 can be manually filled, if desired. At the filing location, each of the discrete pouches 12 can be manipulated such that the enlarged opening 256 appears and items, articles or products can easily and quickly be inserted into the discrete pouch 12. After the discrete pouches 12 have been filled with items, articles or products, the manufacturer will then flatten the open end 26 of each of the discrete pouches 12 and bond or seal the inner surface 40 of the second leg 34 to the inside surface 202 of the first major surface 14. This action will cause the open end 26 of the discrete pouch 12 to be sealed shut. The bond or seal can be formed using heat, pressure, heat and pressure, ultrasonics, an adhesive, a co-adhesive, a mechanical connector, double sided tape, etc. Once the discrete pouches 12 are filled and sealed, the filled pouches 12 can be shipped to a warehouse, distributor, retailer, etc. for sale or distribution to the ultimate consumer.

Referring again to FIGS. 1 and 23, the rearward portion 182 of the machine 10 also includes a removal mechanism 246. The removal mechanism 246 can take on many different forms. By way of example and not as a limitation, the removal mechanism 246 is depicted to include a first belt drive 248 and a second belt drive 250. The first belt drive 248 is positioned vertically above the second belt drive 250. The first and second belt drives, 248 and 250 respectively, cooperate to form a nip 252 therebetween. The first belt drive 248 can rotate in a clockwise direction while the second belt drive 250 can rotate in a counter clock wise direction. The first and second belt drives, 248 and 250 respectively, can include one or more continuous belts movably positioned around two or more spaced apart rollers. The discrete pouches 12 are conveyed from the machine 10 via the nip 252. The speed of the first and second belt drives, 248 and 250 respectively, can be adjusted to be equal to or be greater than the speed at which the discrete articles 180 are advanced through the machine 10. Desirably, the speed of the removal mechanism 246 is greater than the speed of the rearward portion 182 of the machine 10. This increase in speed allows the discrete pouches 12 to be removed continuously without interfering with the advancing discrete pouches 12 leaving the rearward portion 182 of the machine 10. After leaving the nip 252, the discrete pouches 12 can be directed away to be packaged and shipped. In FIG. 1, a slant stacker 254 is shown for moving the finished discrete pouches 12 away from the machine 10. Other means known to those skilled in the art can also be used. Such other means include but are not limited to: a movable conveyor belt, being manually conveyed away; being manually stacked and packaged into boxes for shipment; and being directed to an automated stacker or magazine which will stack and assembly the discrete pouches 12 into packages and route then to storage or to a shipment facility.

METHOD

A method of securing a closure system 28 onto a discrete pouch 12 is also taught. Each of the discrete pouches 12 has a first major surface 14, an oppositely aligned second major surface 16, a pair of sides 18 and 20 joining the first and second major surfaces, 14 and 16 respectively, together, a closed bottom 24 and an open top 26. Each of the discrete pouches 12 can be constructed from a plastic material, from a thermoplastic material, or from some other kind of material. The method comprises the steps of advancing one or more of the discrete pouches 12 through a first station 184 of the machine 10. The discrete pouches 12 are aligned in a machine direction (MD) with the closed bottom 24 leading each of the discrete pouches 12 through the machine 10. The discrete pouches 12 can be advanced using a first continuous conveyor belt 188. A vacuum source 216 can be utilized which will hold each of the discrete pouches 12 secure to the conveyor belt 188 and prevent the discrete pouches 12 from becoming skewed. As the discrete pouches 12 are routed through the machine 10, the first major surface 14 of each discrete pouch 12 will face upward. The first station 184 is capable of lifting and folding a portion of the first major surface 14 upon itself to form a lip 200 having a first surface 202 which is exposed. The second major surface 16 of each of the discrete pouches 12 has an inner surface 206 and a transverse edge 204 located adjacent to the open end 26. The transverse edge 204 is distally spaced apart from the lip 200 such that a portion of the inner surface 206 is exposed. Desirably, at least about 2 inches of the inner surface 206 is exposed.

The method also includes routing each of the discrete pouches 12 downstream from the first station 184 to a second station 222. The second station 222 is capable of positioning and attaching a closure system 28 transversely across the exposed inner surface 206. The closure system including a track 30 having a first leg 32 and a second leg 34 each having an outer surface 38 and 42 respectively. The outer surface 38 of the first leg 32 is secured to the exposed inner surface 206 adjacent to the transverse edge 204. The first and second legs, 32 and 34 respectively, are joined together by an opening/closing mechanism 46. A member 52, such as a slide member, is movably attached to the opening/closing mechanism 46. The member 52 is capable of being manually moved back and forth along the opening/closing mechanism 46 such that the opening/closing mechanism 46 can be opened and closed.

The method further includes routing each of the discrete pouches 12 downstream from the second station 222 to a third station 230. The discrete pouches 12 can be routed to the third station 230 on a second continuous conveyor belt 224. The third station 230 is capable of unfolding the lip 200 and securing opposite ends 242 and 244 of the lip 200 to the outer surface 42 of the second leg 34.

After exiting the third station 230, the pair of sides 18 and 20 of each of the discrete pouches 12 can be manipulated, such as by being squeezed towards one another, to create an enlarged opening 256 located between the first major surface 14 and the outer surface 42 of the second leg 34. This enlarged opening 256 enables items, articles or products to be easily and quickly inserted into the discrete pouch 12. After the discrete pouch 12 has been filled with items, articles or products, the open end 26 is flattened and the outer surface 42 of the second leg 34 is bonded or sealed to the inside surface 202 of the first major surface 14. The bond or seal can be formed using any of the bonding techniques taught above. Desirable, heat and pressure is used to form the bond. The filled discrete pouches 12 are then ready to be shipped to the ultimate consumer.

A more specific method for securing a closure system 28 onto a discrete pouch 12 is also disclosed. As in the method described above, each of the discrete pouches 12 has a first major surface 14, an oppositely aligned second major surface 16, a pair of sides 18 and 20 joining the first and second major surfaces, 14 and 16 respectively, together, a closed bottom 24 and an open top 26. The more specific method comprises the steps of unwinding a web of material 68 from a supply roll 70 and advancing the web of material 68 to a punch station 82. The web of material 68 has a first surface 72 and an oppositely aligned second surface 74, first and second sides, 76 and 78 respectively, and a width dimension w extending between the first and second sides, 76 and 78 respectively. At the punching station 82 a predetermined pattern 84 is punched completely through the web of material 68. The predetermined pattern 84 can be an approximately C-shaped configuration. Desirably, the predetermined pattern 84 is a pair of spaced apart C-shaped configurations. The punched web of material 68 is then longitudinally folded upon itself such that the first major surface 14 is exposed. The punched web of material 68 can be folded at one or more locations so as to form gussets 22, 22 adjacent to each of the sides 18 and 20 of the finished discrete pouches 12. Desirably, six longitudinal fold lines 102, 104, 106, 108, 110 and 112 are present so that a gusset 22 is formed adjacent to each of the sides 18 and 20.

The method also includes bonding the first and second major surfaces, 14 and 16 respectively, together along a single longitudinal line 102 to form a continuous tubular structure 126'. The bond 124 can be formed using any of the techniques described above. Desirably, heat and pressure is used to form the bond 124. Alternatively, a continuous tubular structure 126 can be formed that includes four bonds 124, with each bond 124 being located at each corner of the tubular structure 126. A transverse seal 136 is then formed across the continuous tubular structure 126 or 126' at select locations. The transverse seal 136 is aligned adjacent to the predetermined pattern 84 and perpendicular to the machine direction (MD). The transverse seal 136 can be formed by heating the tubular structure 126 or 126' to a temperature ranging from between about 100° F. to 600° F. and pressing the first and second major surfaces, 14 and 16 respectively, together. Desirably, the temperature will range from between about 200° F. to 500° F. The transverse seal 136 can have a width of at least about 0.1 inches. The distance that the transverse seal 136 is spaced away from the predetermined pattern 84 can vary. Desirably, the transverse seal 136 is spaced within 2 inches of the predetermined pattern 84. More desirably, the transverse seal 136 is spaced within 1 inch of the predetermined pattern 84. Even more desirably, the transverse seal 136 is spaced within 0.5 inches of the predetermined pattern 84.

The method further includes transversely slitting at 178 the continuous tubular structure 126 or 126' adjacent to the transverse seal 136 to form discrete articles 180. The slitting can be accomplished by making a slit or cut 178 in the transverse seal 136. Each of the discrete articles 180 or pouches 12 is then advanced through a first station 184 of the machine 10 in a machine direction (MD) with the closed bottom 24 leading the discrete article 180 through the machine 10 and with the first major surface 14 facing upward. The first station 184 is capable of lifting and folding a portion of the first major surface 14 upon itself to form a lip 200 having a first surface 202 which is exposed. The second major surface 16 has an inner surface 206 and a transverse edge 204 located adjacent to the open end 26. The transverse edge 204 is distally spaced apart from the lip 200 such that a portion of the inner surface 206 is exposed. The discrete articles are then routed downstream from the first station 184 to a second station 222. The second station 222 is capable of positioning and attaching a closure system 28 transversely across the exposed inner surface 206. The closure system 28 includes a track 30 having a first leg 32 and a second leg 34 each having an outer surface, 38 and 42 respectively. The outer surface 38 of the first leg 32 is secured to the exposed inner surface 206 adjacent to the transverse edge 204. The first and second legs, 32 and 34 respectively, are joined together by an opening/closing mechanism 46. A member 52, such as a slid member, is capable of being manually moved back and forth along the opening/closing mechanism 46 such that the opening/closing mechanism 46 can be opened and closed.

Lastly, the method includes routing the discrete articles 180 downstream from the second station 222 to a third station 230. The third station 230 is capable of unfolding the lip 200 and securing opposite ends 242 and 244 of the lip 200 to the outer surface 42 of the second leg 34 to form the discrete pouches 12.

After each of the discrete pouches 12 has the closure system 28 attached thereto, it can be shipped to a manufacturer were the discrete pouches 12 can be filled and sealed. At the manufacturer, the sides 18 and 20 of each of the discrete pouches 12 can be manipulated. For example the sides 18 and 20 and/or the first and second major surfaces, 14 and 16 respectively, can be squeezed, pulled or somehow flexed towards one another, so as to form an enlarged opening 256 adjacent to the open end 26. Since the first major surface 14 of the discrete pouch 12 is bonded to the closure system 28 only at the opposite ends 242 and 244, the enlarged opening 256 will easily be formed. The enlarged opening 256 permits each of the discrete pouches 12 to be quickly and rapidly filled with items, articles or products. Usually for a liquid product or for small granular products, the products can be dispensed into an empty pouch 12 via an injection or hopper system. Alternatively, the discrete pouches 12 can be manually filled, if desired.

After the discrete pouches 12 have been filled with items, articles or products, the manufacturer will then flatten the open end 26 of each of the discrete pouches 12 and bond or seal the inner surface 40 of the second leg 34 to the inside surface 202 of the first major surface 14. This action will cause the open end 26 of the discrete pouch 12 to be sealed shut. The bond or seal can be formed using heat, pressure, heat and pressure, ultrasonics, an adhesive, a co-adhesive, a mechanical connector, double sided tape, etc. Once the discrete pouches 12 are filled and sealed, the filled pouches 12 can be shipped to a warehouse, distributor, retailer, etc. for sale or distribution to the ultimate consumer.

ARTICLE

The finished discrete pouches 12 shown in FIGS. 2-22 and 24-28 will now be described. Each of the discrete pouches 12 can be formed from various materials, described above. Desirably, each of the discrete pouches 12 can be formed from a single, identical material. It should be noted that the closure system 28 can be formed from a different material from the material used to construct the remainder of the discrete pouch 12. Furthermore, each of the discrete pouches 12 can be formed from a laminate having at least two layers. When a laminate is used, at least one of the layers of the laminate can be constructed so as to prevent air, a liquid or a fluid, or a combination thereof, from passing therethrough.

Each of the discrete pouches 12 includes a first major surface 14 having a transverse edge with a predetermined pattern 84 formed therein. The predetermined pattern 84 can be cut out of or be punched out of the material that will form the first and second major surfaces 14 and 16 respectively, as well as the pair of sides 18 and 20. The transverse edge of the first major surface 14 has a pair of opposite ends 242 and 244, see FIG. 27. Each of the discrete pouches 12 also has a second major surface 16 aligned opposite to the first major surface 14. The second major surface 16 has a transverse edge 204, see FIG. 24, with the predetermined pattern 84 formed therein. The predetermined pattern 84 formed in both of the first and second major surfaces, 14 and 16 respectively, has a contiguous boundary, see FIG. 9. The base 90 and the legs 92 and 94 form the contiguous boundary. In addition, the transverse edges of the first and second major surfaces, 14 and 16 respectively, can be contiguous with one another. The second major surface 16 also has an inner surface 206, see FIG. 24.

Each of the discrete pouches 12 also has a pair of sides 18 and 20 joined to the first and second major surfaces, 14 and 16 respectively, by at least one longitudinal bond 124, see FIG. 15, to form a tubular structure 126'. Desirably, four, spaced apart longitudinal bonds 124, 124, 124 and 124 are present approximate each corner of a tubular structure 126, see FIG. 14. Desirably, heat and pressure is use to form the longitudinal bond(s) 124. Each of the sides 18 and 20 can be constructed to contain a gusset 22 or some other expandable structure.

Each of the discrete pouches 12 further includes a seal 136 which extends transversely across the tubular structure 126 or 126' to form a closed bottom 24, see FIG. 16.

Lastly, each of the discrete pouches 12 includes a closure system 28, see is FIGS. 3-6. The closure system 28 includes a track 30 having a first leg 32 and a second leg 34. Each of the legs 32 and 34 has an outer surface 38 and 42 respectively. The outer surface 38 of the first leg 32 is secured to the inner surface 206 of the second major surface 16 adjacent to the transverse edge 204, see FIG. 24. The first and second legs, 32 and 34 respectively, are joined together by an opening/closing mechanism 46 which includes a member 52 capable of being manually moved back and forth such that the opening/closing mechanism 46 can be sequentially opened and closed. The pair of opposite ends 242 and 244 of the first major surface 14 is secured to the outer surface 42 of the second leg 34 to form an open top 26 located adjacent to the transverse edge of the first major surface 14, see FIG. 28. The open top 26 is aligned opposite to the seal 136 and is spaced apart therefrom. The open top 26 is located horizontally between the pair of opposite ends 242 and 244.

It should be understood that the open top 26 of each of the discrete pouches 12 is designed to be sealed after each of the discrete pouches 12 is filled with items, articles or products.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A machine for securing a closure system onto a discrete pouch, said discrete pouch having a first major surface, an oppositely aligned second major surface, a pair of sides joining said first and second major surfaces together, a closed bottom and an open top, said machine comprising:

a) an unwind station to unwind material from a supply roll and advance said material in a machine direction, said material having a first surface and an oppositely aligned second surface, first and second sides, and a width dimension extending between said first and second sides;

b) a punch station to punch a predetermined pattern through said material, said predetermined pattern comprises a pair of spaced apart, approximately C-shaped configurations, each of said pair of approximately C-shaped configurations being aligned along a common centerline which is aligned perpendicular to said machine direction, each of said pair of approximately C-shaped configurations having a base member with two legs extending outward from said base member, and said two legs being aligned approximately parallel to said machine direction and situated downstream from said base member;

c) a folding station located downstream from said punch station to longitudinally fold said material upon itself such that said first surface is exposed;

d) a bonding station located downstream from said folding station to bond said first and second surfaces together along a single longitudinal line to form a continuous tubular structure;

e) a sealing station located downstream from said bonding station to form a transverse seal across said continuous tubular structure which is spaced adjacent to said predetermined pattern;

f) a slitting station located downstream from said sealing station to transversely slit said continuous tubular structure adjacent to said transverse seal to form discrete pouches;

g) a first station to receive and advance said discrete pouches in a machine direction, said closed bottom leading each of said pouches through said machine, said first station lifting and folding a portion of said first major surface upon itself to form a lip having a first surface which is exposed, said lip being aligned approximately perpendicular to said machine direction, said second major surface having an inner surface and a transverse edge located adjacent to said open end, and said transverse edge is distally spaced apart from said lip such that a portion of said inner surface is exposed;

h) a second station located downstream from said first station to position and attach a closure system transversely across said exposed inner surface, said closure system including a track having a first leg and a second leg, each leg having an outer surface, said outer surface of said first leg being secured to said exposed inner surface adjacent to said transverse edge, said first and second legs being joined together by an opening/closing mechanism which includes a member capable of being manually moved back and forth such that said opening/closing mechanism can be sequentially opened and closed; and i) a third station located downstream from said second station to unfold said lip and secure opposite ends of said lip to said outer surface of said second leg.

2. The machine of claim 1 wherein a vacuum is applied against said second major surface of said discrete pouch to maintain said discrete pouch in a predetermined orientation while advancing through said first station in said machine direction.

3. The machine of claim 2 wherein said discrete pouch is advanced through said first station on a movable conveyor belt and said vacuum prevents said discrete pouch from becoming skewed on said conveyor belt while said lip is being folded.

4. The machine of claim 1 wherein said outer surface of said first leg is secured to said exposed inner surface by an intermittent bond.

5. The machine of claim 1 wherein said outer surface of said first leg is secured to said exposed inner surface by a continuous bond.

6. The machine of claim 1 wherein a removal mechanism is located downstream from said third station to remove said discrete pouch with said closure system secured thereto at a speed greater than said speed at which said discrete pouch travels through said third station.

7. The machine of claim 1 wherein said slitting station includes a rotary knife.

8. The machine of claim 1 wherein said first surface of said material is printed and said second surface of said material is void of print.

9. The machine of claim 1 wherein a dancer is located between said unwind station and said punch station, said dancer allowing said advancing material to go from continuous motion at said unwind station to an intermittent motion at said punch station.

10. A machine for securing a closure system onto a discrete pouch, said discrete pouch having a first major surface, an oppositely aligned second major surface, a pair of gusseted sides joining said first and second major surfaces together, a closed bottom and an open top, said machine comprising:

a) an unwind station to unwind material from a supply roll and advance said material in a machine direction, said material having a first surface and an oppositely aligned second surface, first and second sides, and a width dimension extending between said first and second sides;

b) a punch station to punch a predetermined pattern through said material, said predetermined pattern comprises a pair of spaced apart, approximately C-shaped configurations, each of said pair of approximately C-shaped configurations being aligned along a common centerline which is aligned perpendicular to said machine direction, each of said pair of approximately C-shaped configurations having a base member with two legs extending outward from said base member, and said two legs being aligned approximately parallel to said machine direction and situated downstream from said base member;

c) a folding station located downstream from said punch station to longitudinally fold said material upon itself such that said first surface is exposed and a pair of qusseted sides joined to said first and second major surfaces;

d) a bonding station located downstream from said folding station to bond said first and second surfaces together along a single longitudinal line to form a continuous tubular structure;

e) a sealing station located downstream from said bonding station to form a transverse seal across said continuous tubular structure which is spaced adjacent to said predetermined pattern;

f) a slitting station located downstream from said sealing station to transversely slit said continuous tubular structure adjacent to said transverse seal to form discrete pouches;

g) a first station to receive and advance said discrete pouches in a machine direction, said closed bottom leading each of said pouches through said machine, said first station lifting and folding a portion of said first major surface upon itself to form a lip having a first surface which is exposed, said lip being aligned approximately perpendicular to said machine direction, said second major surface having an inner surface and a transverse edge located adjacent to said open end, and said transverse edge is distally spaced apart from said lip such that a portion of said inner surface is exposed;

h) a second station located downstream from said first station to position and attach a closure system transversely across said exposed inner surface, said closure system including a track having a first leg and a second leg, each leg having an outer surface, said outer surface of said first leg being secured to said exposed inner surface adjacent to said transverse edge, said first and second legs being joined together by an opening/closing mechanism which includes a member capable of being manually moved back and forth such that said opening/closing mechanism can be sequentially opened and closed;

i) a third station located downstream from said second station to unfold said lip and secure opposite ends of said lip to said outer surface of said second leg; and j) a removal mechanism is located downstream from said third station to remove said discrete pouch with said closure system secured thereto at a speed greater than said speed at which said discrete pouch travels through said third station.

11. The machine of claim 10 wherein a vacuum is applied against said second major surface of said discrete pouch to maintain said discrete pouch in a predetermined orientation while advancing through said first station in said machine direction.

12. The machine of claim 11 wherein said discrete pouch is advanced through said first station on a movable conveyor belt and said vacuum prevents said discrete pouch from becoming skewed on said conveyor belt while said lip is being folded.

13. The machine of claim 10 wherein said outer surface of said first leg is secured to said exposed inner surface by intermittent bond.

14. The machine of claim 10 wherein said outer surface of said first leg is secured to said exposed inner surface by a continuous bond.

15. A machine for securing a closure system onto a discrete pouch, said discrete pouch having a first major surface, an oppositely aligned second major surface, a pair of gusseted sides joining said first and second major surfaces together, a closed bottom and an open top, said machine comprising:

a) an unwind station to unwind material from a supply roll and advancing said material in a machine direction, said material having a first surface and an oppositely aligned second surface, first and second sides, and a width dimension extending between said first and second sides;

b) a punch station to punch a predetermined pattern through said material, said predetermined pattern comprises a pair of spaced apart, approximately C-shaped configurations, each of said pair of approximately C-shaped configurations being aligned along a common centerline which is aligned perpendicular to said machine direction, each of said pair of approximately C-shaped configurations having a base member with two legs extending outward from said base member, and said two legs being aligned approximately parallel to said machine direction and situated downstream from said base member;

c) a folding station located downstream from said punch station to longitudinally fold said material upon itself such that said first surface is exposed and a pair of qusseted sides joined to said first and second major surfaces;

d) a bonding station located downstream from said folding station to bond said first and second surfaces together along a single longitudinal line to form a continuous tubular structure;

e) a sealing station located downstream from said bonding station to form a transverse seal across said continuous tubular structure which is spaced adjacent to said predetermined pattern;

f) a slitting station located downstream from said sealing station, said slitting station including a rotary knife to transversely silt said continuous tubular structure adjacent to said transverse seal to form discrete pouches;

g) a first station to receive and advance said discrete pouches in a machine direction, said closed bottom leading each of said pouches through said machine, said first station lifting and folding a portion of said first major surface upon itself to form a lip having a first surface which is exposed, said lip being aligned approximately perpendicular to said machine direction, said second major surface having an inner surface and a transverse edge located adjacent to said open end, and said transverse edge is distally spaced apart from said lip such that a portion of said inner surface is exposed:

h) a second station located downstream from said first station to position and attach a closure system transversely across said exposed inner surface, said closure system including a track having a first leg and a second leg, each leg having an outer surface, said outer surface of said first leg being secured to said exposed inner surface adjacent to said transverse edge, said first and second legs being joined together by an opening/closing mechanism which includes a member capable of being manually moved back and forth such that said opening/closing mechanism can be sequentially opened and closed; and i) a third station located downstream from said second station to unfold said lip and secure apposite ends of said lip to said outer surface of said second leg.

16. The machine of claim 15 wherein a vacuum is applied against said second major surface of said discrete pouch to maintain said discrete pouch in a predetermined orientation while advancing through said first station in said machine direction.

17. The machine of claim 15 wherein said first surface of said material is printed and said second surface of, said material is void of print.

18. The machine of claim 15 wherein a dancer is located between said unwind station and said punch station, said dancer allowing said advancing material to go from continuous motion at said unwind station to an intermittent motion at said punch station.

19. The machine of claim 15 wherein a removal mechanism is located downstream from said third station to remove said discrete pouch with said closure system secured thereto at a speed greater than said speed at which said discrete pouch travels through said third station.

* * * * *